US008618954B2

(12) United States Patent
Free

(10) Patent No.: US 8,618,954 B2
(45) Date of Patent: Dec. 31, 2013

(54) MOBILE FLOW READOUT AND MOBILE FLOW SEQUENCER FEATURES

(75) Inventor: James J Free, Elkhart, IN (US)

(73) Assignee: James J Free, Elkhart, IN (US)

( * ) Notice: Subject to any disclaimer, the term of this patent is extended or adjusted under 35 U.S.C. 154(b) by 890 days.

(21) Appl. No.: 12/589,792

(22) Filed: Oct. 27, 2009

(65) Prior Publication Data

US 2010/0164753 A1 Jul. 1, 2010

Related U.S. Application Data

(60) Provisional application No. 61/197,396, filed on Oct. 27, 2008.

(51) Int. Cl.
*G08G 1/00* (2006.01)

(52) U.S. Cl.
USPC ..... 340/932; 340/540; 340/606

(58) Field of Classification Search
USPC ..... 340/932, 910, 929, 907, 540, 603, 606
See application file for complete search history.

(56) References Cited

U.S. PATENT DOCUMENTS

| | | | | |
|---|---|---|---|---|
| 2,019,976 | A | 6/1930 | Huebscher | |
| 3,302,168 | A | 1/1967 | Gray | |
| 3,529,284 | A | 9/1970 | Villemain | |
| 3,544,959 | A | 12/1970 | Hawks | |
| 3,750,099 | A | 7/1973 | Proctor | |
| 3,872,423 | A | 3/1975 | Yeakley | |
| 4,068,734 | A | 1/1978 | Foeller | |
| 4,200,860 | A * | 4/1980 | Fritzinger | 340/929 |
| 5,278,554 | A * | 1/1994 | Marton | 340/910 |
| 5,330,278 | A | 7/1994 | Raswant | |
| 5,821,878 | A | 10/1998 | Raswant | |
| 5,959,553 | A | 9/1999 | Raswant | |
| 6,144,317 | A * | 11/2000 | Sims | 340/907 |
| 6,424,271 | B2 | 7/2002 | Raswant | |
| 6,710,722 | B2 | 3/2004 | Lee | |

OTHER PUBLICATIONS

U.S. Appl. No. 61/197,343, filed Oct. 27, 2008, James Free.
Free, James Paper Published at Intelligent Transportation Society of America Jun. 3, 2009.
www.drivehomesafe.com/article/green_lights_galore_for_improving_traffic_managment-23.html.
gevas.edu/index.php?id=65&L=1.
gevas.edu/index.php?id=149&L=1.

* cited by examiner

*Primary Examiner* — Daniel Previl

(57) ABSTRACT

An invention regarding traffic management is disclosed. A system that tells motorist how fast to go in order to make it through a traffic signal while it is green serves one or more lanes in one or more directions. A Fast Lane On Warning (FLOW) sequencer is in synchronization with traffic phases sequencer (sequencing Red, Green, Yellow, Left Turn and the like) with both sequencers having service cycle period Pi but with start times of both sequencers offset from one another. The FLOW sequencer outputs data, particularly status of signal or "Signal Phase And Timing: SPAT" through wireless means to a mobile receiver/calculator/readout aboard the approaching vehicle. The receiver/calculator/readout also receives data of its location or whereabouts, particularly its distance to the intersection. The receiver calculator readout processes the two incoming data types considering "distance" and "time left" and gives an output of digital, graphic, audio or the like as to how fast the motorist should go to make it through during green.

25 Claims, 19 Drawing Sheets

STREAMING SIMULTANEOUS INPUT

MOBILE FLOW READOUT AND MOBILE FLOW SEQUENCER FEATURES

STATEMENT REGARDING FEDERALLY FUNDED RESEARCH AND DEVELOPMENT

Not Applicable

REFERENCES

U.S. Pat. No. 2,019,976 Huebscher June 1930 180/98
U.S. Pat. No. 3,302,168 Gray January 1967 340/932
U.S. Pat. No. 3,529,284 Villemain September 1970 340/942
U.S. Pat. No. 3,544,959 Hawks December 1970 340/942
U.S. Pat. No. 3,750,099 Proctor July 1973 340/932
U.S. Pat. No. 3,872,423 Yeakley July 1975 340/932
U.S. Pat. No. 4,068,734 Foeller 1978 180/169
U.S. Pat. No. 4,200,860 Fritsinger April, 1980 340/929
U.S. Pat. No. 5,278,554 Marton Jan. 11, 1994 340/942
U.S. Pat. No. 5,959,553 Raswant Sep. 28, 1999 340/907
U.S. Pat. No. 5,821,878 Raswant Oct. 13, 1998 340/907
U.S. Pat. No. 5,330,278 Raswant Jul. 19, 1994 404/1
U.S. Pat. No. 6,144,317 Sims October 2000 340/907
U.S. Pat. No. 6,424,271 Raswant Jul. 23, 2002 340/907
Audi, Travolution, July 2008
GEVAS Travolution
U.S. Pat. No. 6,710,722 Lee July 2002 340/910
Ser. No. 6/197,343 James Free Oct. 27, 2008
Free, James Paper Published at Intelligent Transportation Society of America Jun. 3, 2009

FIELD relates to systems that tell motorists how fast they need to go in order to get through a traffic signaled intersection while the light is green. More specifically, in doing so while receiving data wirelessly into mobile onboard readouts

BACKGROUND INCLUDING PRIOR ART

Traffic systems have been developed over the years that tell vehicles how fast to go to get to the green light.

Examples are to be found in Gray (U.S. Pat. No. 3,302,168), et al, 1967, Proctor (U.S. Pat. No. 3,750,099) July 1973, Yeakley (U.S. Pat. No. 872,423) March 1975, theoretically laid out by Villemain, (U.S. Pat. No. 3,529,284) September 1970. While these examples lack an algorithm to properly compress the traffic, and while they identify a zone to allow traffic a means to a green phase, they encourage a possibility to exceed the speed limit.

Other inventions over the years and in other countries have had traffic signals "blink" to indicate an upcoming signal change as represented by Fritsinger, U.S. Pat. No. 4,200,860, April, 1980, and where they even have mention of "gasoline-saving". This method is of risk to safety in multiple senses including the encouraging of speeding. Also, while it is safer to observe the traffic signal while also gathering information on when it will change, it is safer yet to be especially attentive of conditions immediately surrounding the motorist and vehicle. A quick "on-board" glance would allow for better attention to the road than straining ones eyes towards a distant signal. Finally, the upper levels of where the most mobility can occur, as well as the most savings of energy sources based on this inventors' research will involve speeds that are near the highest posted. Because of this, a signal will be far enough away from a given intersection (miles in some cases), that typical motorists will not be able to interpret these kinds of outputs; the signal will be too far away for signal-bound outputs to be read.

While cross reference to related application Free (U.S. Ser. No. 6/197,343) describes an algorithm for compression, and while an emplaced RSU (roadside unit) could afford immediate and full ranging use by motorists as soon as it is installed, the invention presented here would provide an advantage of closer more comfortable safer way of receiving readouts than roadside emplacements as well as the on-board mobile device lending itself to higher resolution and a safer means of reading outputs, and a safer way of keeping eyes on the road.

Resolution would not only be in terms of visual resolution, though that would also weigh as an important factor, but resolution as a function of readout per time, and ultimately precision in maintaining one's place in the hierarchy after compression. If there were too few readouts per time there would not be enough data coming in and there would be a resolution issue. Further clarification of this type of resolution could be expressed as the number of updated readouts per second. If a readout were taken in every 5 or 7 seconds, there could be room for error in properly executing FLOW speed assignments. A mobile readout could provides for an "infinite" set of readouts (and an infinite set of reevaluations) as opposed to "integer" increments of an emplaced readout. A mobile readout could also offer more possibilities of media than an emplacement. These possibilities include sound, graphics, alphanumerics, any of which could lend themselves to higher resolution.

Further, while roadside emplacements will provide for all motorist as well as backup for broken mobile readout and mobile readout enhancement, the emplaced readout resolution can be only in full integer increments and many contemporary speedometers in analog are incremented in 5 mph increments. This leaves more room for resolution issues.

Instead of using the parameters of cross reference to related application FeREE the infrastructure ("emplaced" RSU readout Ser. No. 61/197,343) with a fixed place, the continuously changing location parameter is input and updated many times per second by a location device "on the fly" affording many reevaluations and thus much more position relevant readouts as well as higher resolution.

Speeds may be compared in my invention like in Foeller (U.S. Pat. No. 4,068,734) except Foeller has is no algorithm and the invention presented here allows driver to drive and does not suggest to take over those driving privileges like in Foeller. A dangerous threshold is crossed in taking over of the vehicle wherein my invention provides for a more background suggestive approach to bringing in traffic though the green. Also, a vehicle where control is relegated from the driver to automatic systems is a recipe for disaster especially when it comes to vandalism ("hackers").

Dangers are present with involving wireless with anything other than a private network. Public network as in Lee (U.S. Pat. No. 6,710,722) are also prone to vandalism (i.e. "hackers") and jeopardizing safety.

Audi, Travolution in association with GEVAS and Technical University of Munich, Office for Traffic Management and Geoinformation, City of Ingolstadt, et al, has conducted research with mobile readouts. They apparently are associated with "Genetic Algorithms" which are associated with mathematic concepts called "Evolutionary Methods". Apparently, the "Genetic Algorithms" used were "very successful in solving optimization problems which are too complex for conventional methods". Apparently the system uses sensors to try and develop itself using "hundreds of parameters" in a "large solution space". In my invention, the traffic signal in association with the status output sent through wireless transmitter in association with on-board receivers functions as an autonomous-like individual unit that manages traffic. While my invention can work well in multiple signaled systems with complex inter signal algorithms or massive interconnecting networks like in Raswant (2002, 2001, et al) Travolution, et al. (i.e. using the master slave relationships that will be disclosed in this specification), it can just as easily, and probably more safely, work as an autonomous system acting on a single intersection. My system can either let opposing runs (i.e. N-S lanes; E-W lanes) take turns sending traffic patterns through during a green light, or if it is all that will warrant it, letting a single Fast Lane On Warning (FLOW) lane through during the green for a single direction. The processors that would be needed in my invention are straightforward and would use the minimum of hardware to consolidate the traffic to a green zone.

A mobile readout also is anticipated in inventions of Foeller (U.S. Pat. No. 4,068,734), Huebscher (U.S. Pat. No. 2,070,432), however, there is no mobility offered and therefore no incentive offered to motorists.

The readout HMI (human machine interface) allows data to stream aboard in an animated, sprite or the like that has very high resolution per unit time as opposed to a more "memorize a number and act" or an incremental stair step whole number input at best.

With cross reference to related application FREE (Ser. No. 61/197,343; Oct. 27, 2008) There are certain executions of data-streaming that can be reduced to practice with the output readings as an emplacement or RSU (Roadside Unit) as part of the infrastructure. However, the more streaming they are, the more complex and expensive to run they would be. Having the readouts on board the vehicle also affords the use of sound, light, graphics both separately or together.

DESCRIPTION OF THE INVENTION including OBJECTS

A Traffic Phase Sequencer runs through a series of phases that total a service cycle period of Pi or "period of the intersection". The phases usually include Red, Green, Yellow and could just as easily include others like Green arrow for left turn and so on. A Fast Lane On Warning or FLOW sequencer also has a period of Pi and has a start to its sequences offset form the start of the traffic phase sequences. The FLOW sequencer puts out data which could take any different kind of form including a changing "frequency" or a series of sentences, packets, packages or "micro-" events or the like (including an actual frequency or set of frequencies). That output information would include how long the period Pi is, how long the "net" green is, how far into the period Pi the receiver/vehicle would be at that instant, Pa. The system can be applied to single lane, multi lane, specific readouts; i.e. for FLOW pattern of left turn, FLOW pattern for going straight and so on. Multidirectional FLOW traffic in opposing (perpendicular) directions, i.e. North-South vs. East West, would take turns going through green per the same intersection.

The sequencer of a mobile readout system could either be an integrated system that together puts out RGY as well as FLOW outputs or a FLOW sequencer could be added onto a phase sequencer in "parasite" or "piggyback" form. Such a parasite might include its own programmable timer that takes cues form the RGY phase sequencer so that FLOW sequences would remain in sync with phase sequences. While the phase sequencer might take precedence over the FLOW sequencer, the FLOW sequencer could autonomously put out outputs for a number of Pi multiples during a certain period of time, taking updates or corrections occasionally from the phase sequencer. The updates, corrections would prevent "drift" between the Pi of RGY and the Pi of FLOW.

In considering traffic management of guiding vehicles through a signaled intersection while the signal is in the green phase, the following partial differential equation must be considered:

$$\frac{\partial V}{\partial t} = \frac{\frac{\partial X}{\partial t}}{\frac{\partial T}{\partial X}}$$

It reads as "The variation of speed with respect to real time is equal to the variation of instantaneous remaining length to intersection with respect to real time per the variation of time left in the RGY sequence with respect to the variation of instantaneous remaining length to the intersection."

The equation essentially grows from the equation (X=V/t), where V is speed, X is position (how far from the intersection), t is time. Consider two aspects for guiding traffic through the traffic signal while it is in Green phase:

1. That the traffic must be formed into a green zone.
2. That zone must be a lot smaller in time with respect to the whole period Pi.

Specifically, the length of the "aggregate" consolidated FLOW pattern during a time of "net" green is smaller relative to the length that it was before any traffic management occurred, or before any readouts/assignments were given. In this previously random pattern, the pre consolidated FLOW pattern length was the product of Pi (period of the intersection) times the speed limit.

For these considerations, the differential equation is of little value. However, a SOLUTION to that equation is very important.

The solution equation presented below affords the parameters of forming, compressing, consolidating traffic from a random open string of vehicles to a FLOW pattern just before it reaches the intersection. The parameters must include safety above all else. Because of this, the first parameter is that in consolidating, the pattern cannot exceed the speed limit. Other parameters that are necessary in the employment of safety are the assurance that speed assignments do not cross-assign each other. In other words that while their speed assignments will converge, vehicles will not be given assignments that will cause them to overtake or pass one another while they are approaching the traffic signal. Further, the above parameter somewhat dictates that the ending FLOW pattern be kept to a reasonable amount in the same configuration, order, proportion of hierarchy as it was in when it approached the trap or FLOW zone before any consolidation took place.

Concerning forming, compressing, consolidation of a FLOW pattern the applicable solution to the above equation is:

$$Vsa = \frac{X}{(Pi - Pa) + Pi + pgS - \left[1 - \frac{(Pi - Pa)}{Pi}\right]Tng}$$

where

Vsa is output of speed assignment,

X is position or distance to the traffic signal,

Pi is service cycle of the traffic signal,

Pa is the arrival point in time where X is taken, Pi−Pa is a countdown function such that Pi>Pa>0 pgS is safety buffer "pre green" time period where earlier arrivals waiting traffic and the like can be accounted for, Tng is the "net" green or time segment of the green phase that is intended for FLOW traffic. All the consolidated traffic goes through the intersection during this time.

(1−((Pi−Pa)/Pi))Tng is the "net green" function dealing with the range, how long it is, of green which is intended for FLOW traffic. Tng can be "set" by expanding pgS and Tsf so that G-pgS-Tsf=Tng. If Tng is very small (i.e. as Tng approaches 0) it becomes more like a point in time within G that can be a single place or "target" positioned by how big pgS is (G>pgs).

A processor that is a receiver/calculator/readout, RCR which may or may not include extra functions such as timers and on board memory, is on board the vehicle. Two main inputs to the receiver/calculator/readout are LOCATION input and STATUS input.

Some time before the mobile receiver reaches the node (or where the FLOW readings start compressing the pattern), and begins receiving status data, it also downloads the vehicle's location by means including but not restricted to the following: GPS, Enhanced GPS (RF signals that serve as routers of that same data), RF signals generated from the locality of the FLOW intersection, Other communication media could include LORAN (Long Range Navigation), visual (bar code type), light (laser, infrared, UV and the like), video, sonic, ultrasonic, pneumatically or mechanically actuated access points, wireless mesh, cellular wireless data, RF with purpose-built towers and base stations, VOR (very high frequency omnidirectional readout), or a smaller more local version of this, cross-referencing of two different VOR type outputs, combinations of the above, or other like communication media.

Individual vehicles are guided through a run up or "open" zone where vehicles "go the speed limit" up through the part where consolidation is done called the "trap". Once in the trap, vehicles are consolidated or compressed (per time) by means of converging speed assignments within a hierarchy.

The hierarchy, called a FLOW Pattern (FLOW meaning Fast Lane On Warning), compresses per time a previously random full length (Pi*Speed limit) pattern of traffic into a pattern short enough in length and as a small enough time fragment relative to the total Red Green Yellow cycle RGY that the whole Flow Pattern of vehicles makes it through during green phase.

Different settings of safety time (and therefore distance as well) buffers on the leading and trailing part of the Green phase pgS (pre-green safety), at the beginning part of green, and a "safety following" Tsf in the after part of green, make extra space to absorb wayward traffic. Examples of wayward traffic include early arrivals, stragglers, vehicles who turn onto the FLOW lane.

To consider Tng in FLOW consolidation, compression per time is focused on a smaller adjustably settable zone within the Green phase, Tng ("net" green). In other words, the time of the FLOW Pi at the beginning of the entrance to the trap at the node (the last node is the last point in the run-up that has a full set of FLOW readouts per the period Pi) is compressed into the Tng. Also, the distance of the FLOW pattern starts at the beginning of the trap by being 1 trap length and by the time it reaches the FLOW intersection, it is [(trap length)*Tng/Pi]

The wireless output could be a single or multiple frequency as well as a series of sentences or packages sent out many times per second. In order to function as guiding vehicles in through the light while it is green, the receiver/calculator/readout would need to receive two main inputs: distance to intersection and time left till their "particular space" or slot in the hierarchy should go through the intersection. Other important information would need to include the time durations of the whole Pi of the intersection (as well as the FLOW pattern at initial consolidation, compression) and the time duration of Tng.

The downloading of each sentence as an event could trigger off a scan and constantly update a calculation. The scan could be triggered by either location sentence or traffic light status sentence with the other incoming sentence used as a background that always inputs until an interrupt event of the triggering sentence happens again. For example, an incoming sentence could be a position (X) input. As soon as the input is established, a status of the intersection is listened for, and once heard (T), the calculation is made. Another incoming input of new position (X') causes a new scan and another calculation to take place with an updated status (T'), and so on. Each X and T could be put through the calculation which ultimately outputs a readout.

In the receiver/calculator/readout, varying degrees of memory and on-board sophistication can trade off with reliability ease of use and cost. A mobile readout can be simple and inexpensive if it can be made to be set off on a per scan basis and triggered by an input. In its simplest form, the input would trigger the scan and readout. It would have little or no on board memory and would be inexpensive but vulnerable to missing or corrupted wireless data transfers. Such a minimal-memory receiver might have durability due to simplicity in hardware. Many of these scanning events per second would still allow for reasonable continuity, and reasonably high resolution in the mobile readout.

If medium to high amount of memory-stow capability is aboard and timers can be included in the receiver/calculator/readout, the cost might be more, but the reliability with respect to outputs might be strong. This would be due to methods of preserving readouts in the event of corrupted wireless data inputs.

If memory is aboard, there could be either event-based interrupt programming or memory buffer usage with constant stream of inputs. With event based, there could be time out based events or just as easily, input initiated events or both. If either of location or status inputs was used as a constant background or default input (or frequency), that default could be constantly ran and update/overwrite logged until a time out occurred. Once the time out occurs, the "listener" would be shifted to the non default input and upon the logging of the first complete non default package, sentence (or frequency), the default time stamp would be OK'd as being contemporary enough, and that would trigger the two inputs to be processed for a scan and a readout update. As well, once the output occurred, the default sentence listener would be triggered on again and the timeout timer countdown started again for the next cycle. The default packages, sentences or the like in the timeout period would repeat itself often enough to make sure a complete package made it to the memory in the event of occasionally corruptible wireless data. The more frequently the scans, the more reliable the data and outputs would be.

The two inputs with the most recent time stamps would be selected, calculated, outputted, and the rest of the buffers would be emptied and left to go back in the listening/fill mode.

Alternatively, "streaming" inputs could serve as downloads instead of events. Using memory buffers with different status and location ports with both data sources streaming at the same time is just as plausible. Constant incoming streaming data (i.e. sentences or frequency) that could include time stamps can be funneled in through both ports at the same time. The most recent matching time stamps would be easy for the processor to pick as the status is time anyway, and if GPS is the location means, it too is based on time. Once the up-to-date stamped sentences are chosen, the rest of the old stream is emptied out (deleted or overwritten), and the processor goes back into the listening/fill mode ready to repeat the process for the next scan.

With wireless technology, there are always challenges with getting complete sentences or packages through. The balance between keeping the decibels (i.e. wireless power) low and the required distance range of first-needed-encounter as far as many miles, there is a chance that the wireless transmissions get corrupted sometimes. Having the receiver/calculator/readout include a timer and some memory could boost dependability in receiving wireless readouts by including in the processor a function of a one dimensional inertial navigation system. Interruptions of incoming "real" or "true" data of status, position, or both could cause the receiver/calculator/readout to defer to on board substitute data. Once an initial set of data was downloaded, it could be "logged". The log could include a place and time. More specifically, the time could include the likes of Real Time Clock or particular time left from the intersection FLOW sequencer, and the place could include a derivation of X; how far it is to the intersection. With the time left to intended intersection slot known, as well as distance to intersection known, the processor could function in "virtual" fashion and self guide the vehicle the rest of the way to an intersection.

If the Status, SPAT data were to be corrupted, a timer, activated at first knowledge of Status data loss could back up to give time left to arrival of the particular "slot" so the calculations could remain in process.

If location data were corrupted, distance to intersection X could still be processed by solving for it given the known velocity from the speedometer in the vehicle and the time left till the arrival in the particular slot or position in the FLOW Pattern. The signal phase and timing (SPAT), and velocity could be ascertained by either the speedometer and/or the location device (RF, GPS, enhanced GPS, for example).

If GPS were a main location ascertaining means, the velocity style readouts from GPS, as well as position, could function easily enough to use change in velocity paradigm for inertial navigation.

In simpler terms for position or velocity:

$$V_{sa} = V_{actual} \pm \frac{dx}{dt}$$

Vsa=speed assignment which could be based on the first complete sentence that got through; in other words, Vsa is a "known"

V(actual)=the speed from the GPS or speedometer.

dx/dt=either actual physical location per the latest time in a countdown, but could also be the change in relative location within a FLOW pattern. Also, the whole term could be change in relative velocity as varied form the original assignment.

Any versions of the term dx/dt can be ascertained by calculation of location and velocity and time.

Even an off-calibrated speedometer can be improved upon by GPS inputs. And time can be calibrated or updated by GPS since GPS is a time based mechanism.

Since real time actual data of status and location could serve to be more accurate for readouts, there could be prioritization or a master slave relationship between actual functioning "real" or "true" sentences or packages and backup inertial navigation where the actual sentences could take precedence over inertial navigation calculation. The actual data could serve to recalibrate the calculation.

Other factors which could increase the dependability of wireless package transmission could include fragmenting sentences up so that if partial data still made it through, that data from the previous packet would still be viable. There would have to be enough scans per time for this to work, and they would have to be close enough in time. If there were enough scans per time, there could be a limiting time delay in the receiver that would allow an "outdated" downloaded datum to be still processes as long as it was still within a time frame, i.e. within a few milliseconds.

Still other methods of increasing the reliability of wireless data could include a pre-download of the data so that if there were missing sentences or missing parts, there would be time enough to still get in reliable data before a readout would occur. In other words, download the data, wait with the readout, allow time for accuracy to establish itself before readout occurs. This could be considered as "future" time stamps, and the use of Real Time Clock (RTC) could come in handy.

A digital numeric readout, or interactive readout could be included as a human interface, (HMI "human machine interface") for an outlet for the algorithms of Vsa, speed assignment. As well, there could be more graphic, sonic possibilities in the readout, i.e. noises (bells, beeps, buzzers, whistles and the like), voices (i.e. "too fast" and/or "you can speed up"; "you may go faster" or the like) arrows saying go faster, slower, equal sign for correct speed. A sonic package or enhancement can be worked into the interface that would allow the driver to keep his/her eyes on the road, intersection, and signal at all times. Interactive graphics could include speed assignment or "speed to go" as compared to "actual" or "speed you're going". More interactive graphics could include a "column" graphic that represents a layout of the FLOW pattern and column position within the pattern. The algorithm would be Tng/slot position.

Mobile readouts could be processed as if they were started (i.e. consolidation were started) at a distinct threshold or "node". The node (borrowed form from wave physics) could be defined by X=Pi *(Speed Limit) where X=distance of node from traffic signal intersection, Pi=cycle period; R+G+Y). This would be the place where there would be a full set of readouts during the whole range of Pi. As one would move in closer towards the intersection, there would begin to be voids, or blank spots where there would not be standard assignments. Mathematical enhancements could cause substitute readouts if they took place in a void. For example, if a vehicle lagged too far behind and got out of the range of reasonable readouts, there could be very unusually slow readouts that would bring the vehicle into the next upcoming FLOW pattern.

But just as easily, a looser interpretation of node could include traffic management considerations to start somewhere in the range of wireless transmitter at signal. In the looser interpretation, there may not need to be as clearly a defined area of a trap. It would include less rigidly defined mathematical enhancements, i.e. where they could all be readouts with reconsideration to the offset of starting times. Mobile readout processes could be applied anywhere in the run-up, with the threshold consideration taken each time a scan is done. The reconsidered phase offset would be between Pi of RGY vs. Pi of FLOW readout status information.

The compression is consistent in that those vehicles arriving at the start of a FLOW service cycle, arrive at the beginning of the "net green" period, Tng. While the beginning FLOW Pi vehicles arrive at the beginning of the Tng, those at the end of a FLOW Pi are compressed but still organized so that they end up at the end of the Tng time period, as well as the end of the FLOW Pattern while they go through the intersection. The vehicles are consolidated at the beginning first and "fed in" so that a first part of a FLOW pattern might be consolidating while the latter part might still be random. Also, the first part of a FLOW pattern going through the intersection might be through the intersection (and thus finished being managed) while the latter part might still be in consolidation.

Should the receiver/calculator/readout come near an intersection and appropriate run-up, the processor would have to be woken up. Methods to do this can be initiated by status input, location input, or both. Considering status first, if the receiver/calculator/readout gets near enough to the intersection the signal gets strong enough and the receiver starts receiving status inputs and triggering location data (always there anyway) to be taken down or stowed. The decibel magnitude of the intersection and FLOW lane for example would cause the wake up.

For a location example, a GPS (i.e. a location device) can use preprogrammed map that compares to actual vehicle location in real time. If actual coordinates of a vehicle approach those on a preprogrammed map, a wake up would be triggered. After a wake up, the receiving processing would more accurately scan to make sure the vehicle was on the correct street, and correct FLOW lane, that it was going in the correct direction and so on; it would scan for status messages.

Once the system is awakened, the data (status, location and in what type of conditions, periods) are downloaded into the receiver calculator output. Once this data is received, the mobile part of the system does calculations to reach the FLOW intersection at the particular place in the hierarchy or FLOW Pattern that coordinates with when they arrived across the node or place where FLOW readings start.

Obvious other necessary features include for completion and abort/U-turns

Once the vehicle is approaching very close to the intersection, the system at the readout level shuts itself down and vehicle proceeds through the green light.

Further precautions include requirements for directional security. This is easy to do with GPS but could be easy with other means like RF, Mesh, using different channels (especially for noise regarding different (perpendicular) directions), focusing beams, placing more multiple signals with not as strong as an output, etc. Direction finding must be present if events like /U turns took place (receiver system shut off) and being sure that vehicles were going in right direction towards intersection as well as data not getting mixed up with a pattern in an opposing (perpendicular) direction. Precautions would need to be in place that are the same as traffic signals where if there is a failure or ambiguity, the system shuts itself down.

While coordination and timing of lights is nothing new, conditions can be favorable where there is a string of signals that use or involve themselves with FLOW systems. While the first FLOW trap will organize from random traffic, the following FLOW sequencers in a string of coordinated intersections can maintain an already organized pattern and especially enhance it, first by clarifying placement in a FLOW hierarchy, and also by allowing for stragglers and vehicles that turn on to a FLOW lane during compression. If the signals are far apart, separate FLOW sequencers can do a combination of independently outputting and starting all over again in speed assignments to random patterns. Far apart signals can be loosely coordinated with one another at "open" speeds.

Going from rural to downtown or metropolitan conditions taking into account individual intentions of each motorist, represents a diminishing capable functionality of FLOW systems. However, if designed into the infrastructure, FLOW systems can save local expenditures of fuel and reduce local pollution even more if worked in with the networks and infrastructure.

Object

It is an object of this invention to provide for a method of telling individual vehicles what speed they need to go in order to get through a traffic signal while it is in green phase.

It is another object to do so with maximum resolution in terms of readouts per time.

Further it is n object to provide for a straightforward better ergonomic means of perceiving readouts through graphics, audio as well as alphanumerics.

It is another object to increase safety through easy to read HMI, minimum interactive, and high resolution per time readouts, and including audio, all of which allows motorist to better keep eyes on the road.

Another object is to provide for straightforward methodology, lending itself to reliability.

Still another object is to optimize the wireless link, and to provide for durability, reliability, safety, and dependability in spite of interruptions and corruptions of wireless transmissions, and optimize the fail safe operation of wireless based speed assignments.

Another object of this invention is to provide for directional and functional security for potentially multiple directions and converging speed assignments Other objects will become evident upon further disclosure of this invention.

DRAWINGS

A DESCRIPTION OF A PREFERRED EMBODIMENT

The following preferred embodiment is proposed for the purposes of disclosure and clarification. By no means and under no circumstances does it represent the only form the invention could take.

Figure 1:
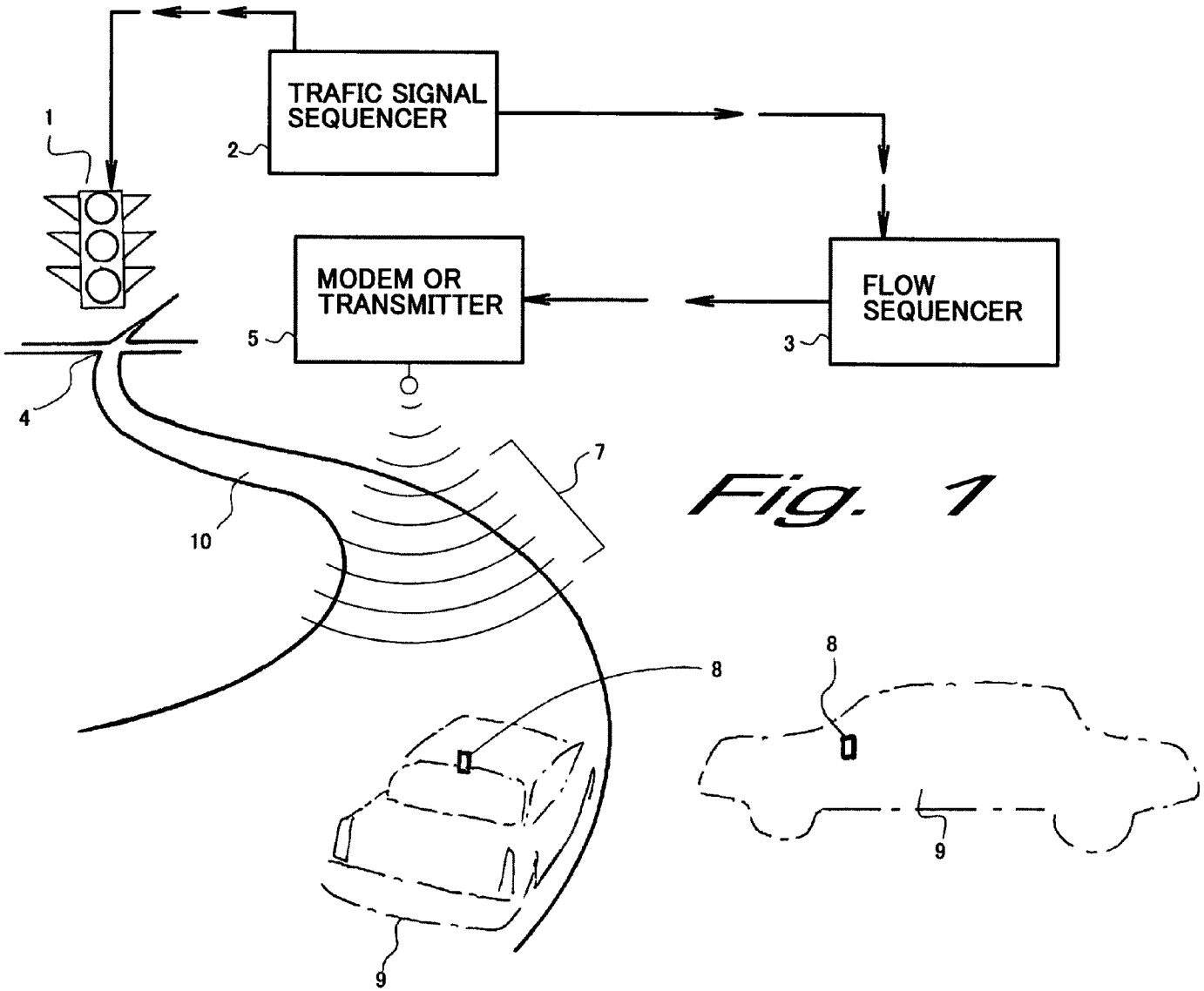
FIG. 1 shows main components and priorities including traffic light sequencer, flow sequencer, transmitter or modem, receiver/calculator/readout.

A traffic light signal 1 in [FIG. 1] is controlled by a traffic signal sequencer 2 which works in timing synchronization with FLOW (Fast Lane On Warning) Status (Signal Phase And Timing; SPAT) output sequencer 3, both governing intersection 4 sending output through modem or transmitter 5 that transmits wireless data packet, sentence, signal 7 into receiver/calculator/readout RCR processor 8 aboard vehicle 9. Signals 7 start to be received by receiver/calculator/readout RCR processor 8 on board approaching vehicle 9 while still very far away in run up 10. In [FIG. 2], Location device (GPS, local RF or the like) 11 sends wireless signals/data 6 into location receiver 12 through receiver port 13 into Receiver/Calculator/Readout 8. Also, signal 1 FLOW data 7 is sent into status receiver 14 through status port 15 into receiver/calculator/readout (RCR) processor 8 which after processing data of location, distance, and time left sends readout to output 16.

Figure 3:
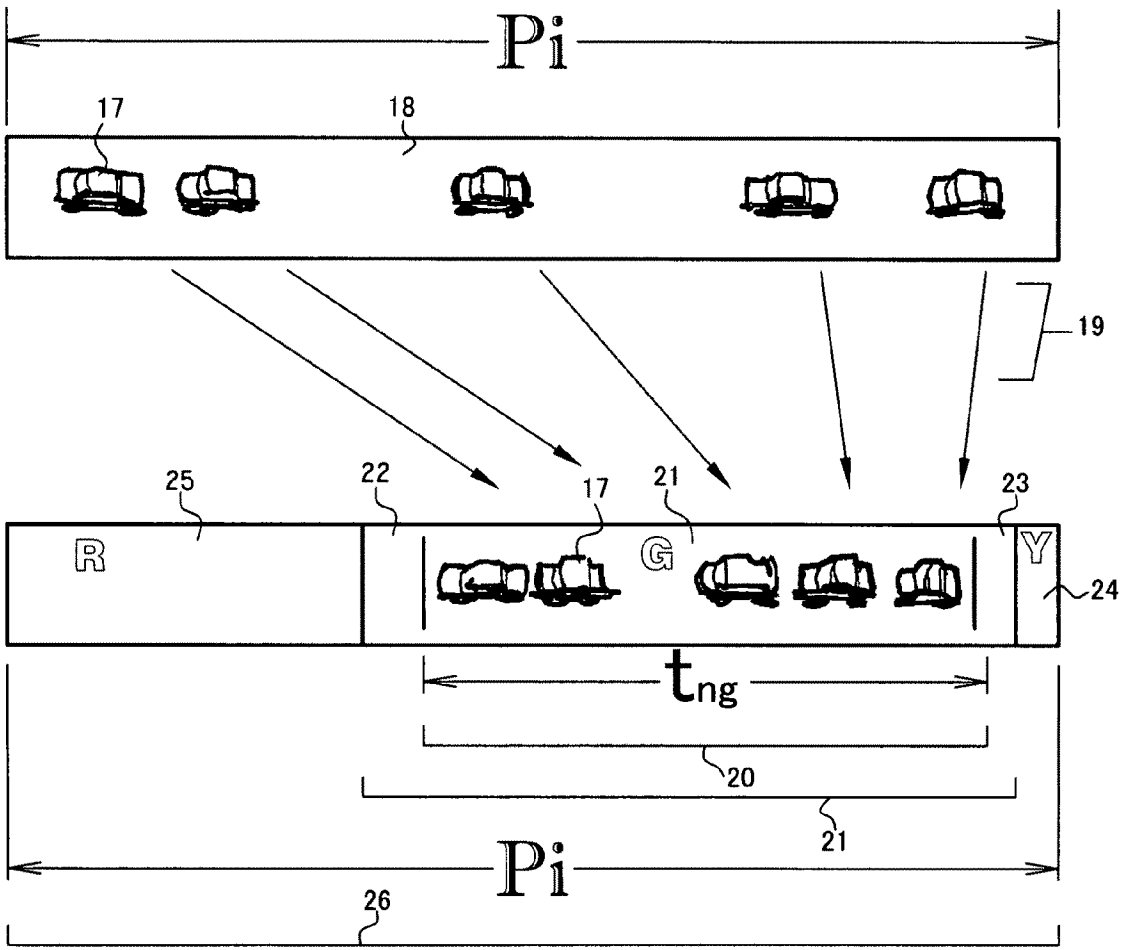
FIG. 3 shows basic compression diagram including pre compressed random traffic pattern as well as post compressed pattern going through traffic signal.

In [FIG. 3] Vehicles 17 approach during travel on run up 10 (in [FIG. 1]) before any traffic managing or assigning takes place, in a time period of Pi 18 which would be the service cycle period of the intersection, and also represent a length Pi*Speed Limit. After being consolidated, compressed 19, vehicles 17 are contained per time within a "net" green, Tng time period 20 which is part of the total green phase 21 with that green phase 21 including pgS safety "before" buffer time period 22 and Tsf period of safe following time buffer "after" 23. With the phase of Green 21, there would also be phases time periods of yellow 24, and Red 25. The Red Green Yellow phases, RGY 21, 24, 25 would add up to become the service cycle period Pi of and at the traffic signal 26. This Pi would be the same as that taken in the random pre consolidation, pre-compression pattern of the run up 18.

Figure 4:
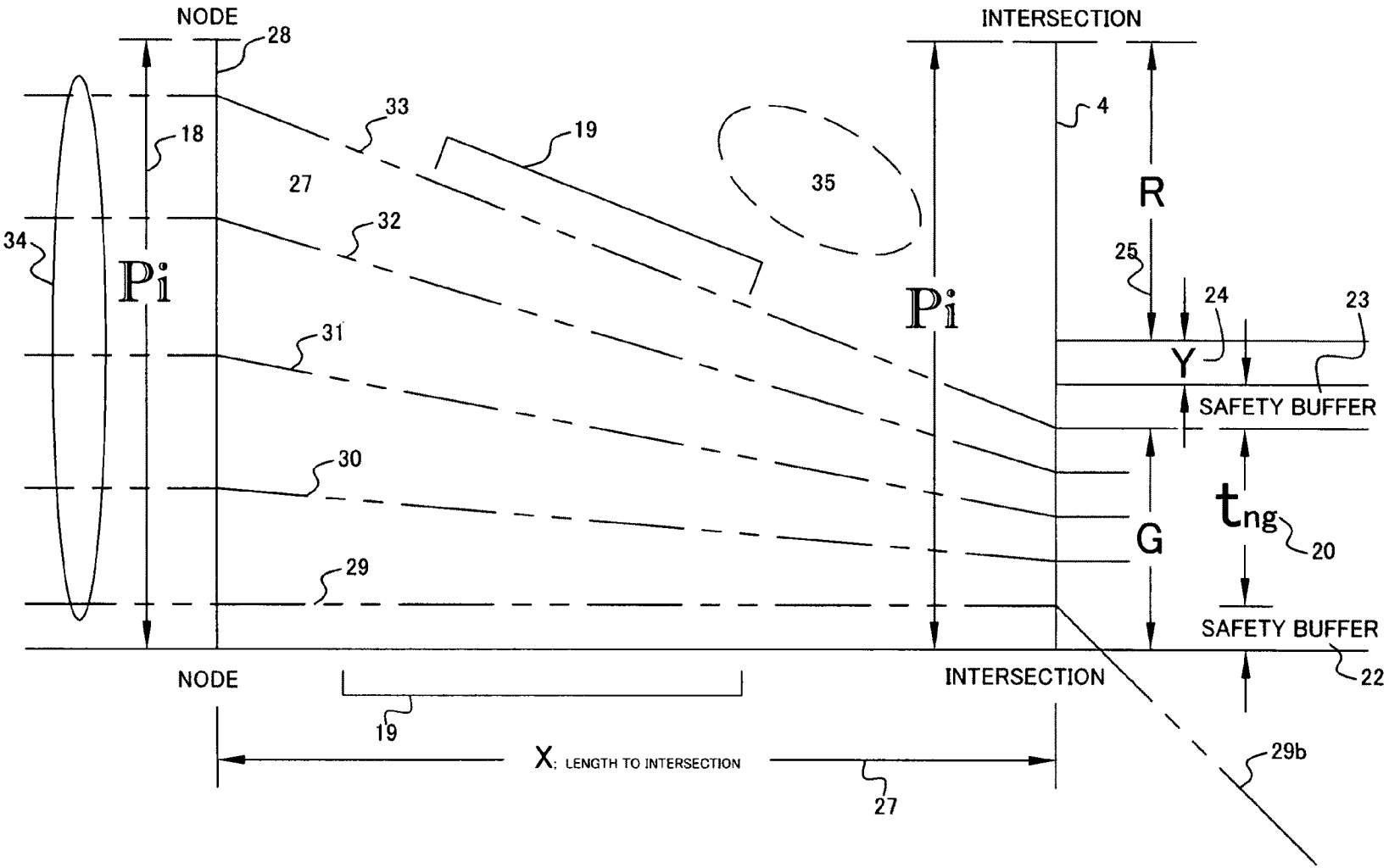
FIG. 4 shows a "relative time in the FLOW pattern" verses a "distance to intersection" chart with proportions the same as with "relative distance in FLOW pattern" including plots of converging speed assignments.

In [FIG. 4], a chart of distance along trap 27 verses relative vehicle time (distance) in the FLOW Pattern plots relative progress in compression 19. Horizontal axis is distance "X" 27 from node 28 (a node being a point where compression starts), to intersection 4. Vertical axis is relative position in FLOW pattern, first (left side) as random pattern time length Pi 18 (while that axis could just as easily represent length). At the left of the node 28 would be the vehicles 34 which are distributed throughout the pattern before compression 19 and at the right of the node 28, the vehicles plotting individual paths 29, 30, 31, 32, 33, would progress through compression, each getting closer to one another in time as well as distance, until they projected throughout a time (as well as distance) phase length of Tng 20. Before compression 19 the vehicles 34 were randomly distributed and went the speed limit. They did not gain on each other in relative time and space till after they crossed the node 28. After crossing the node 28, their relative following times and following distances converged towards one another until the whole FLOW pattern was within Tng 20. The Tng 20 is surrounded by pre FLOW safety buffer pgS 22, and followed by Tsf safety following time buffer (as well as distance) 23. Once traffic cleared intersection 4 it would be able to increase speed as needed and disperse again in time and space, particularly lead by vehicles at the front of the pattern 29 *b*. the first. While through the intersection, 4 represented at that point along the trap "X" 27, the compressed traffic Tng 20 would go through a Pi with phases Red 25, Green 21, and Yellow 24. While traffic would be compressed in space and time, there would begin to be voids, or blind spots, "vacated areas" 35, that would form just after traffic began to cross the node 28 in [FIG. 4]. The function of compression is to not have vehicles where the voids 35 are, and to have the void place and time exist during the red phase 25

Figure 5:
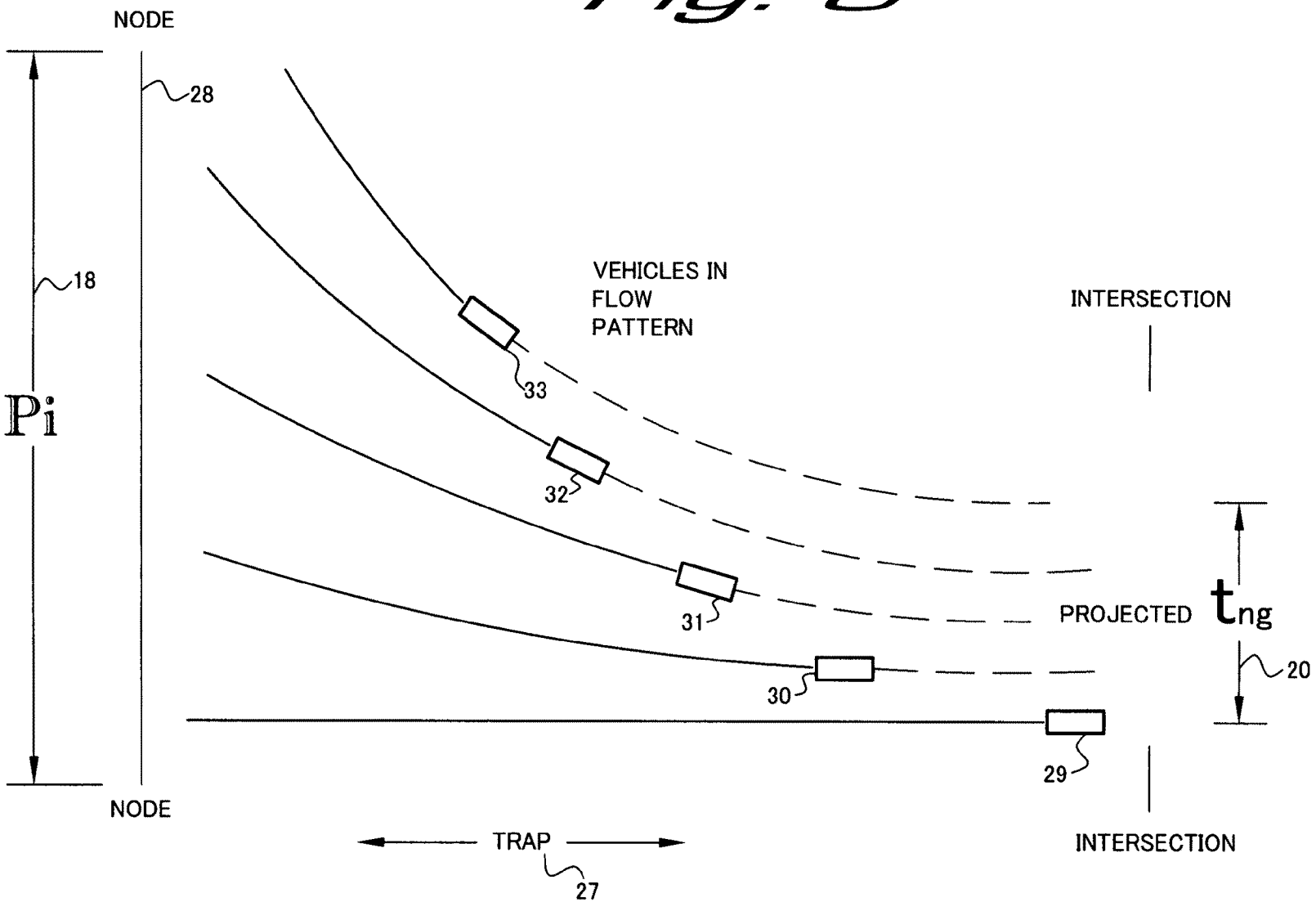
FIG. 5 shows feed-in nature of the hierarchy and FLOW pattern.

Using the same general layout as in [FIG. 4], looser interpretation [FIG. 5] traces the same horizontal axis "X" 27 as a length along the trap, with vertical axes serving as relative time within the FLOW Pattern that could just as easily be distance. On the left would be the node 28 with Pi of a random pattern 18, and on the right would be a projection of Tng 20 (as part of a RGY Pi at intersection not shown in [FIG. 5]). The realistic progress of a flow compression in [FIG. 4] would have the FLOW pattern in a feeding out and feeding in or "spilling" of individual vehicles going at their particular assignments with first vehicle 29 arriving before next vehicle 30 which arrives before next vehicle 31 which arrives before next vehicle 32, which arrives before next vehicle33, and until the end of the FLOW pattern.

Figure 6:
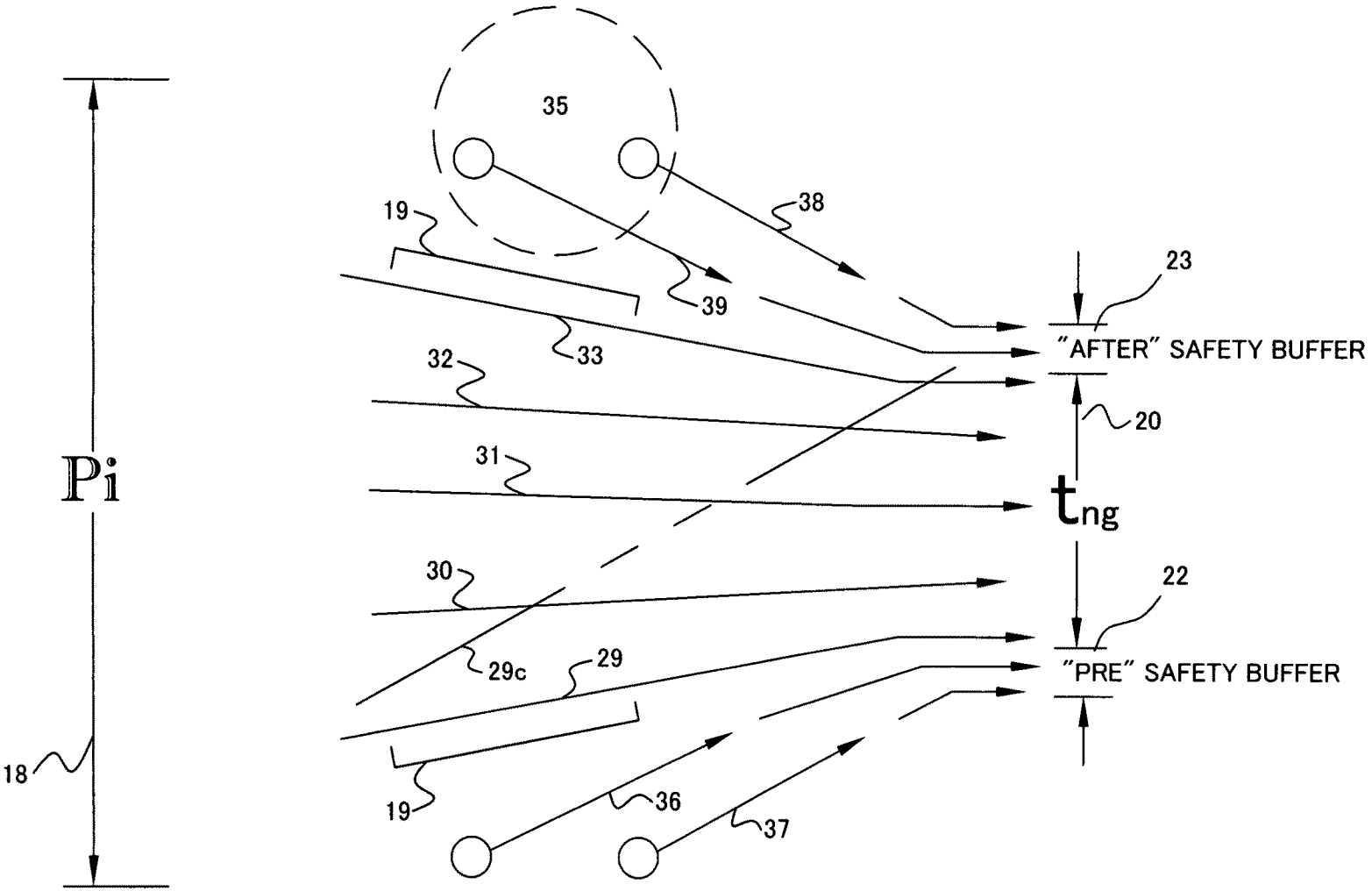
FIG. 6 shows a looser relative time (distance) in FLOW pattern versus distance from intersection including wayward traffic entering at points along that distance, and mathematically enhanced wayward vehicles being funneled into time buffers before and after FLOW net green.

In [FIG. 6] the same axes are used as in [FIGS. 4 and 5]: Horizontal is the distance along the trap 27 (not shown in [FIG. 6]), with vertical being a relative time (distance) between vehicles in a FLOW pattern. At left is a random Pi 18 at node 28 (not shown in [FIG. 6]), and right including a projection of net green Tng 20, with safety buffer times (distance) in front and back 22, 23, implied traffic from voids 35 is shown. Compression 19 is shown with typical vehicle paths converging to within the projection of net green Tng 20. Vehicles that would happen to be in a void would be able to be guided into buffer periods using mathematical enhancements or the like including vehicles 36, 37 especially from void before FLOW pattern (i.e. from the previous Pi 18), being lead into forward buffer 22, and vehicles being lead from behind the FLOW pattern 38, 39, directed into after buffer Tsf 23. Cross assigning as shown with 29 c is discouraged as much as possible and is more effectively dealt with using higher resolution capabilities of mobile readouts 8 (in [FIG. 1]).

Figure 7:
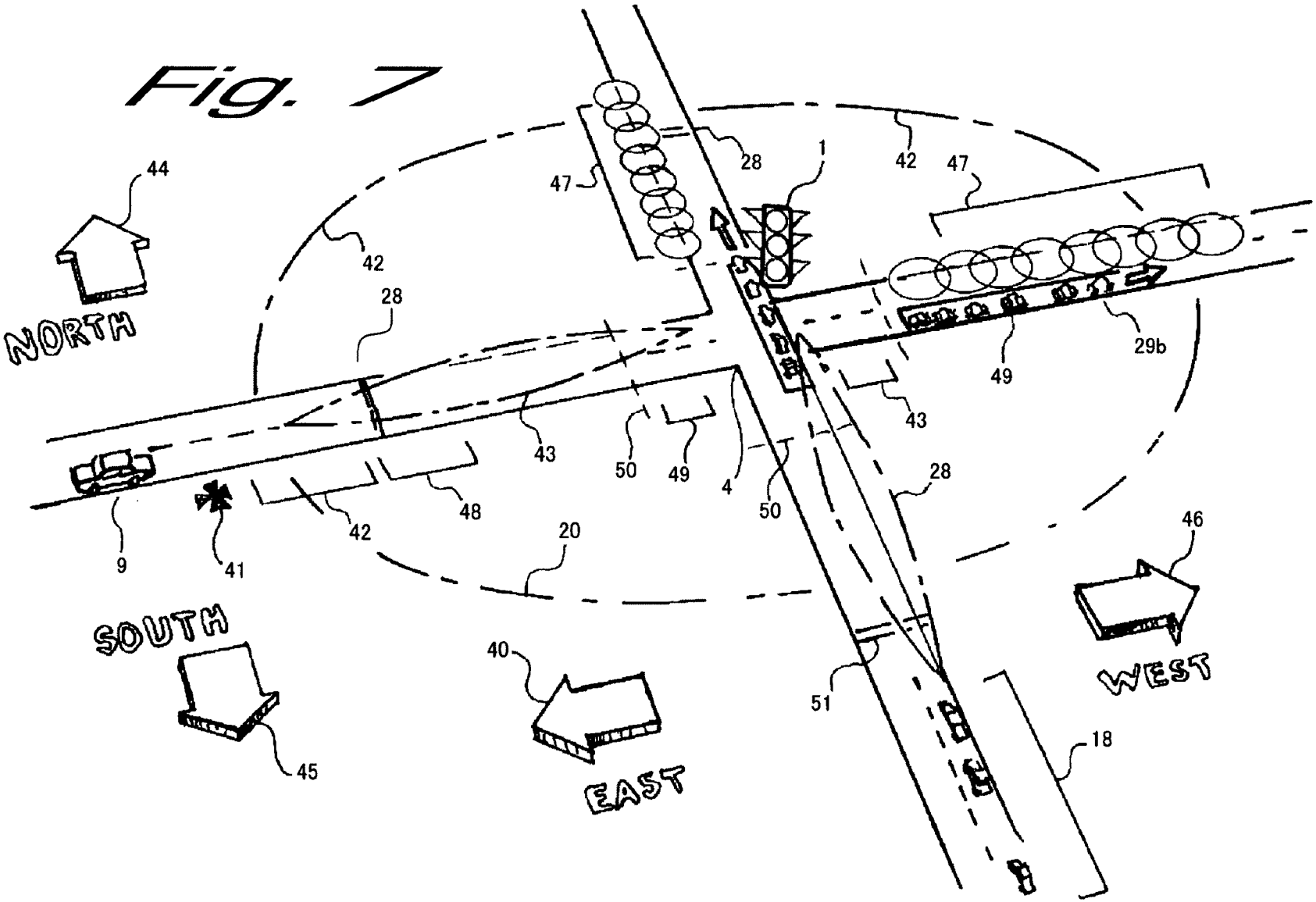
FIG. 7 shows a diagram of a four way intersection including node, single wireless transmitter geometry, multi wireless transmitter geometry, power within range geometry, and including example of FLOW patterns taking turns going through green phase of traffic signal.

In [FIG. 7], approaching vehicle 9 coming from East Direction 40 can approach the real coordinates of a virtual access point 41. As the real coordinates numerically come close to comparable "virtual" ones (not shown), the system wakes up, continues receiving location inputs, and starts scanning for status inputs. Just as easily, the vehicle could come within proximity range 42 where status signals from FLOW sequencer 3 (in [FIG. 1]) at traffic signal 1 at intersection 4 are generated. Once the power from FLOW sequencer intersection 4 was large enough to activate RCR 8 (in [FIG. 1]) in vehicle 9, the system would wake up. After wake up, the wireless signals would begin to be received and processed by vehicle 9 through a reasonably focused single RF signal Fresnel 43, perhaps at a frequency of 900 MHz, or 700 MHz. The single RF signal Fresnel would be focused narrowly enough that approaching vehicles coming from the East direction 40 would not get readouts confused with those approaching from the North direction 44, the South Direction 45, or the West Direction 46. Also, directional security could be facilitated by differing encryption (not shown). Just as easily, directional security (as well as proximity wake up methodology) could be obtained by a network, "mesh" or the like of very local, very low power RF transmitters or modems 47 running at higher frequencies, for example near a 5.9 GHz frequency. The readouts of frequency and location would be connected well before the vehicle 9 crossed the node 28, or before the vehicle entered the node range 48 on its way to approaching intersection 4. During the vehicle's 9 transition through the trap between node 28 and intersection 4, the vehicle 9 receives readouts that tell it what speed to go in order to get through the signal 1 while in the green phase. As the vehicle nears the intersection 4, it reaches a "finish zone" 49 and after vehicle 9 crosses the shut off point 50, the no-longer-needed FLOW readouts cease. By the time random pattern of traffic 18 before node 28 (signified as coming from South direction 45), gets to intersection 4, the FLOW pattern is compressed 20 to a time and distance (space time) where it can travel through the intersection 4 while light is in green phase as a "net" green pattern, Tng (also shown going from the south direction 45 to the north direction 44). After a FLOW pattern goes through the green, the vehicles of released pattern 51 (traveling in the West Direction 46), never having had to stop, can disperse again. The dispersed pattern 51 is lead by first released vehicle 29 b which is allowed to go the speed limit again. Released pattern 51 has already gone through the intersection 4 while signal 1 was green. Signal in East West directions 40, 46 is now red. Signal 1 for North South Directions 44, 45 is now green, while FLOW pattern during net green Tng 20 is progressing through. The signal 1 is trading net greens so that FLOW patterns 51, 20, and 18 can take turns going through green while they do not have to stop for opposite (perpendicular) directions of traffic.

Figure 8:
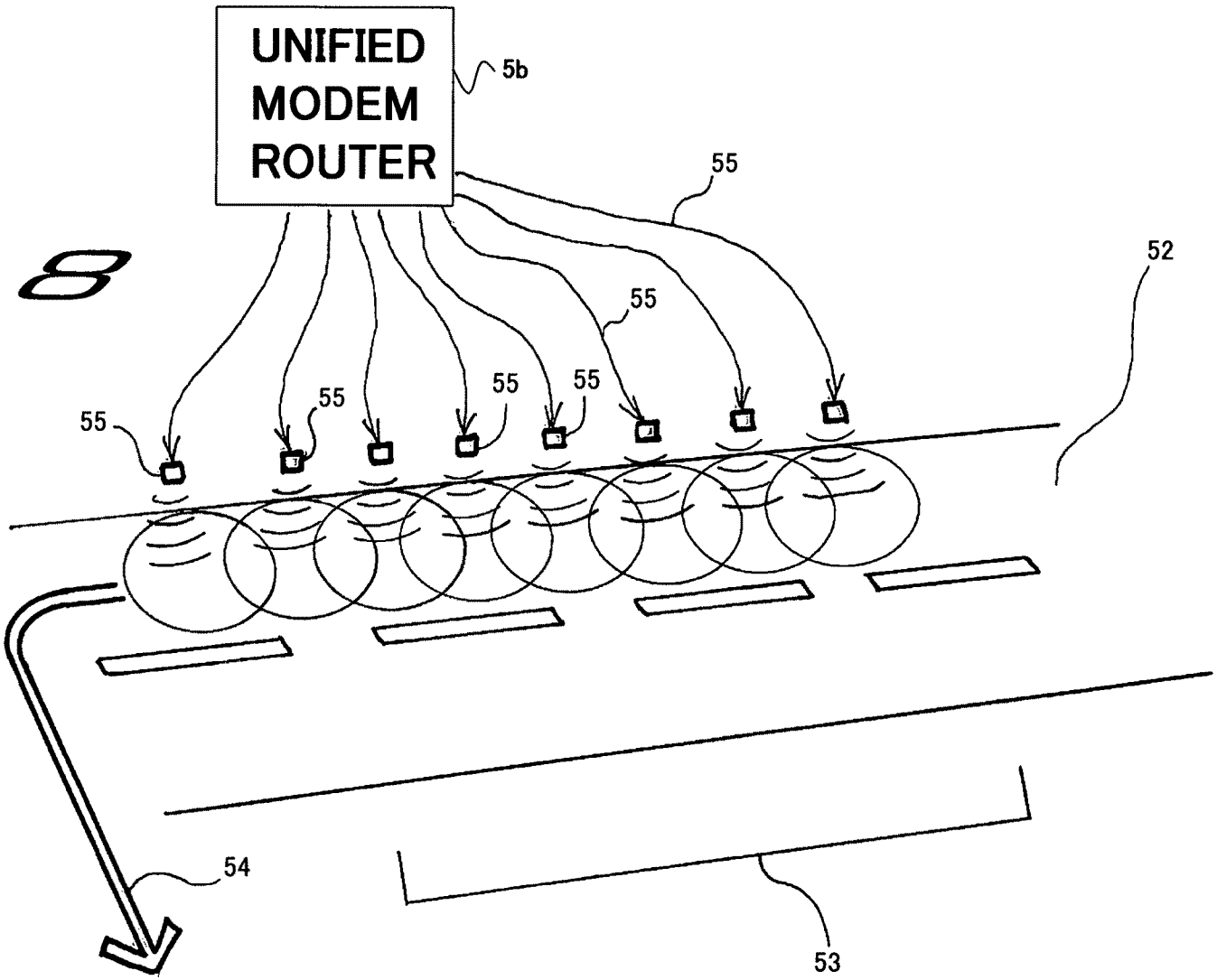
FIG. 8 shows a detail of multiple wireless transmitter.

The system of localized low power RF transmitters 47 runs at higher frequencies where each transmitter 55 operates with low enough power that a FLOW lane 52 in a roadway 53 (in [FIG. 8]) would be near enough for them to be heard, but if the close confines of the FLOW lane 52 were perpendicularly vacated 54 the signal would be too weak to be picked up. Each higher frequency transmitter 55 would be directly networked 56 (through cable, wireless, optic, or the like) into unified transmitter/router 5*b* such that each transmitter 55 was signaled essentially simultaneously so that there wouldn't be any latency from point to point, but the signal would be transmitted uniformly.

The wireless signal 7 in [FIGS. 1 and 7] could consist of a data packet, sentence or the like which would include the major functions including "how long the Pi is" 57, "how long the Tng is" 58, "where Tng is in the period Pi" 59, "how far the data point (in time) is into the period Pi, or Pa" 60, "how much more time till the beginning of Tng" 61, "how much more time till the slot arrival comes" 62. The last two phrases 61 and 62 may be able to be derived by the mobile RCR 8 and may not have to be included in a status packet 7.

Figure 10:
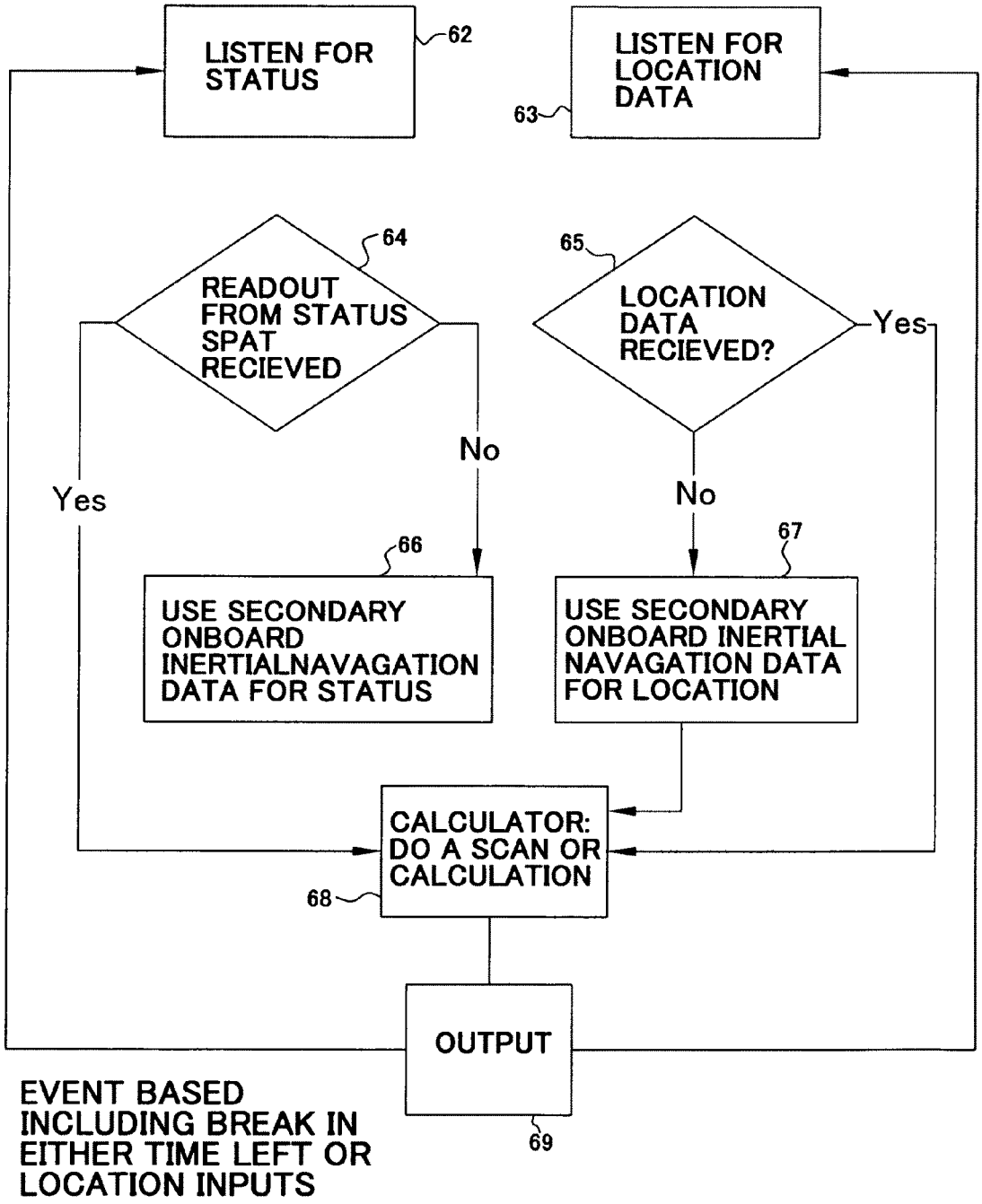
FIG. 10 shows a basic chart of the inputs and example of event based activity of receiver/calculator/readout.
Figure 11:
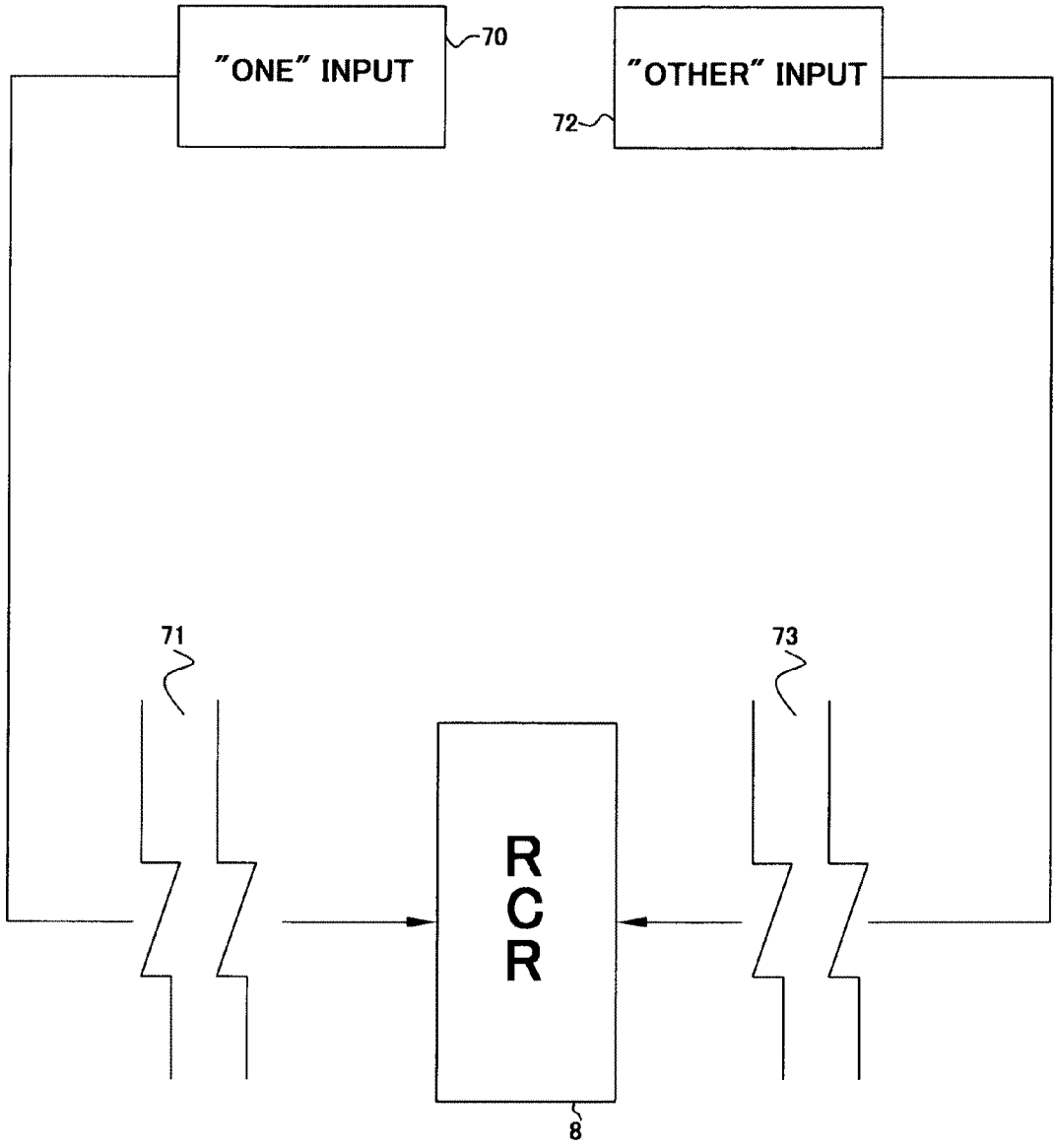
FIG. 11 shows two inputs each where signal can be broken.

An extra enabled receiver/calculator/readout (RCR) 8 includes onboard timer and onboard memory. This mobile processor receives two inputs of status 14 and location12 (in [FIG. 2]). Each function includes listeners: status listener 62 and location listener 63 in [FIG. 10]. Once status is received 64 and location packet is received 65, secondary onboard status memory is loaded 66, and secondary onboard location memory is loaded 67. Status 64 and Location 65 packages are passed through to the calculator 68 which scans and enters an output 69 at which time another scan is initiated with the process starting over. A simpler event based RCR of [FIG. 11] could possess memory for only one input and have the signal (completed sentence packet) for the other to initiate the scan.

Figure 12:
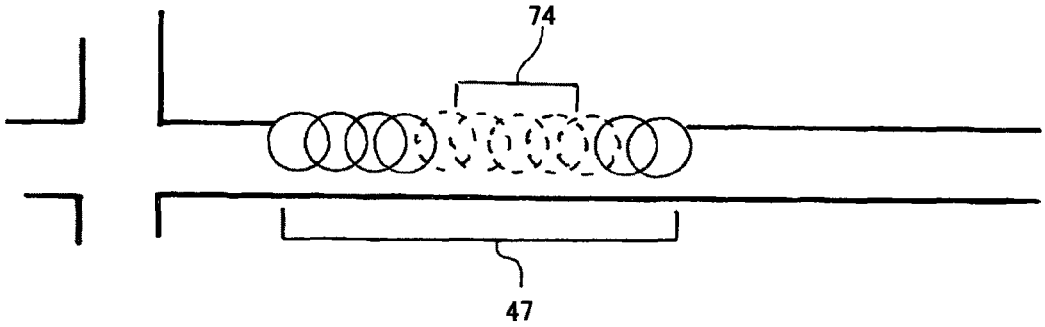
FIG. 12 shows example of data corruption in multiple wireless transmitter.
Figure 13:
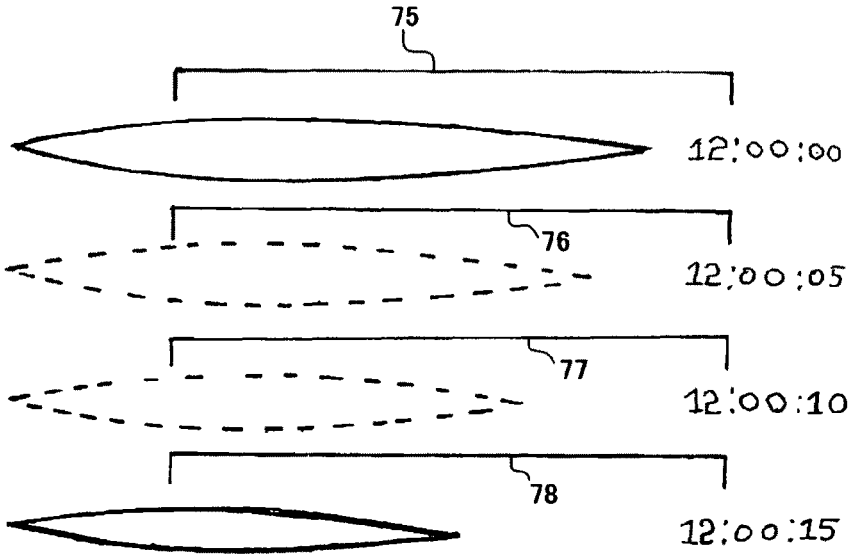
FIG. 13 shows example of data corruption in a focused single wireless transmitter.

The onboard backup capability of RCR 8 includes two inputs "one" input 70 breakable transfer medium 71 and the "other" input 72 with breakable transfer medium 73. In the event that there is a break, blackout, or corruption of the GPS or local RF Location reception 12 (in [FIG. 2]), or if there is a break in the reception of status data 14 (in [FIG. 2]), onboard timer and memory capability will allow for substitute data 66, 67 in [FIG. 10] to be processed. Non-reception of data 74 in [FIG. 12] could happen from low power transmission network 47 causing missing data packets 74. Similarly, transmission from a single focused transmitter: can work OK for a sentence A at time AA 75 in [FIG. 13], be interrupted in sentence B at time BB 76, be interrupted at sentence C at time CC 77, and not resume successful inputs until Sentence D at time DD 78.

Figure 2:
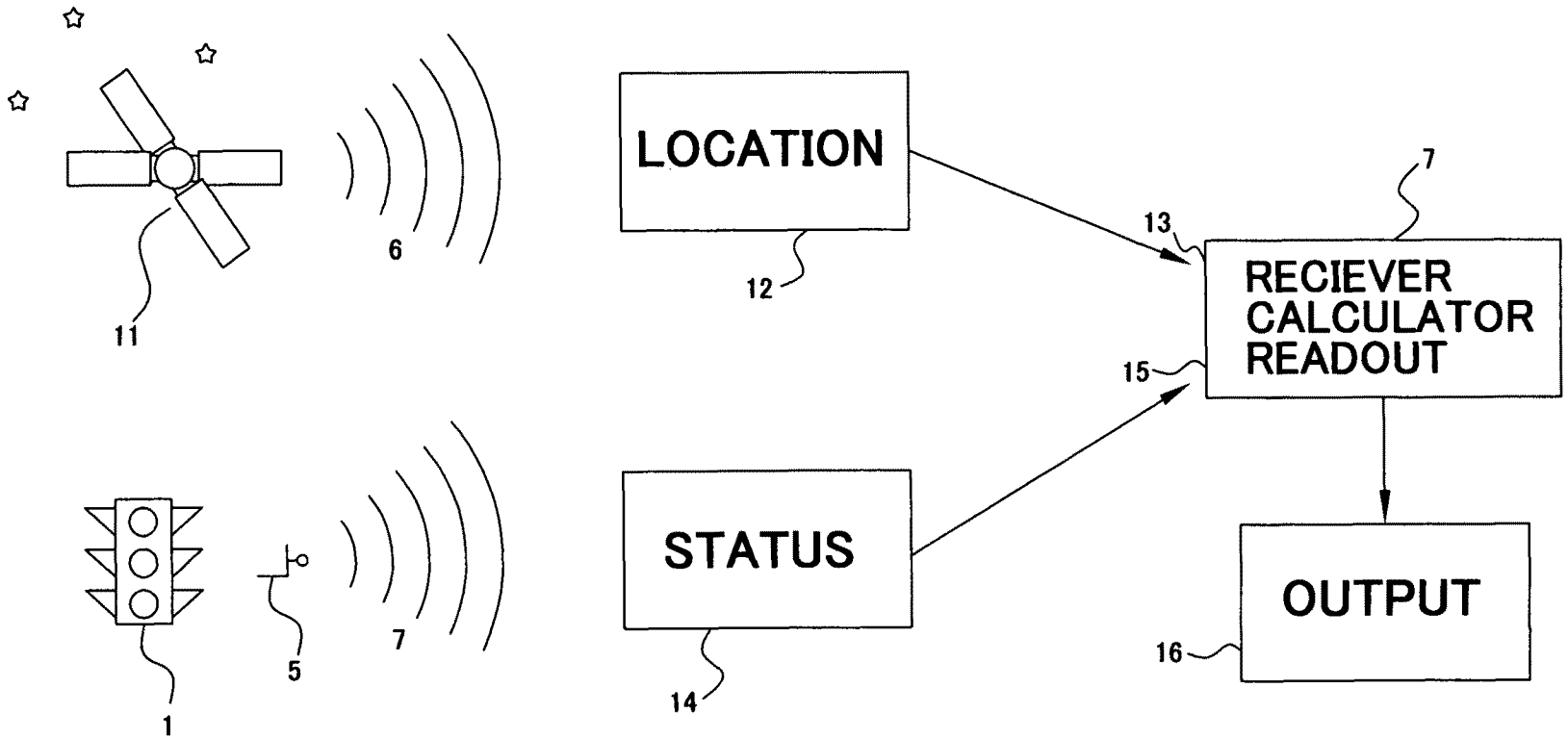
FIG. 2 shows receiver/calculator details.
Figure 9:
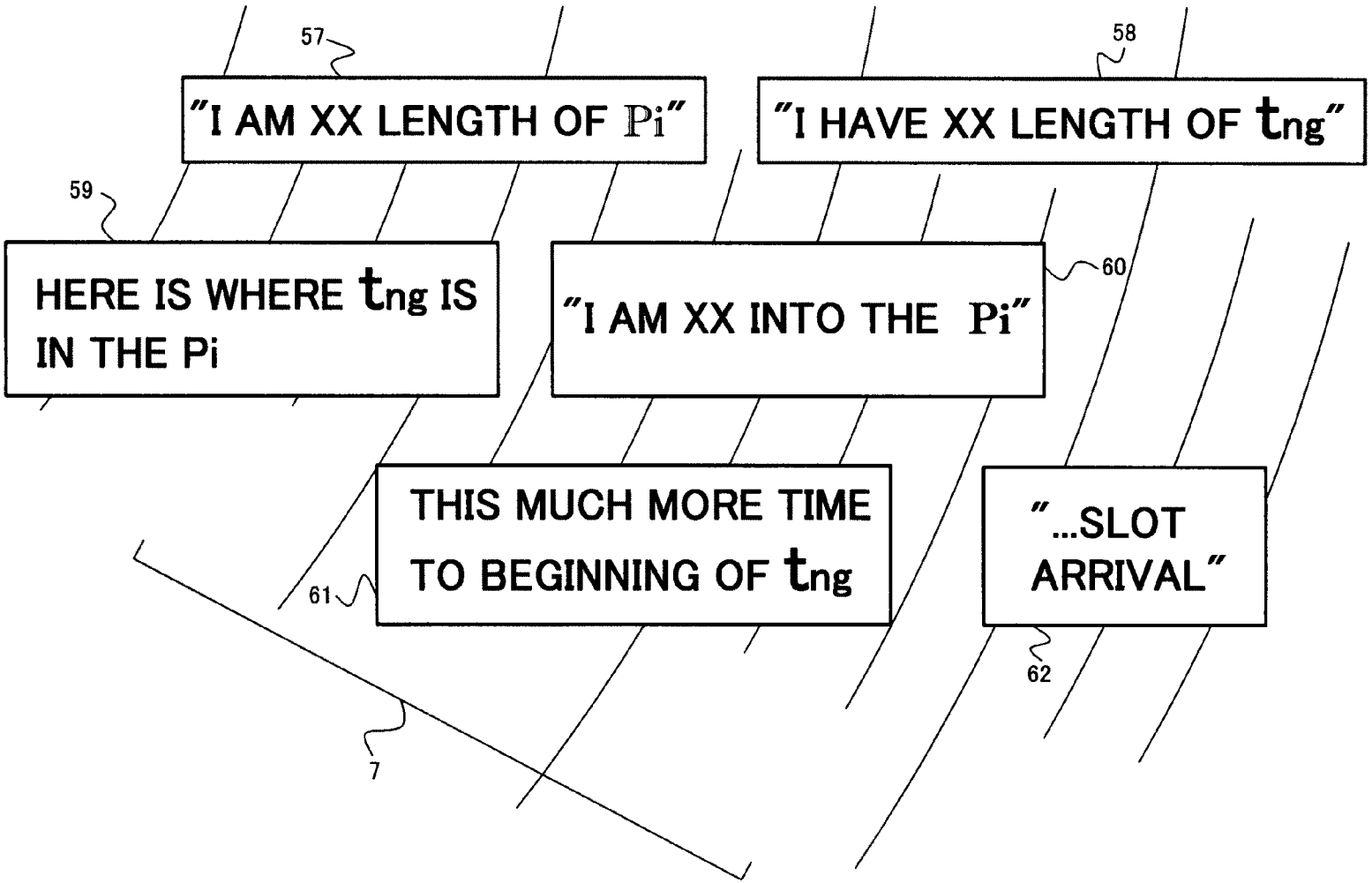
FIG. 9 shows the details of a wireless sentence or packet that would from the FLOW sequencer at intersection.
Figure 14:
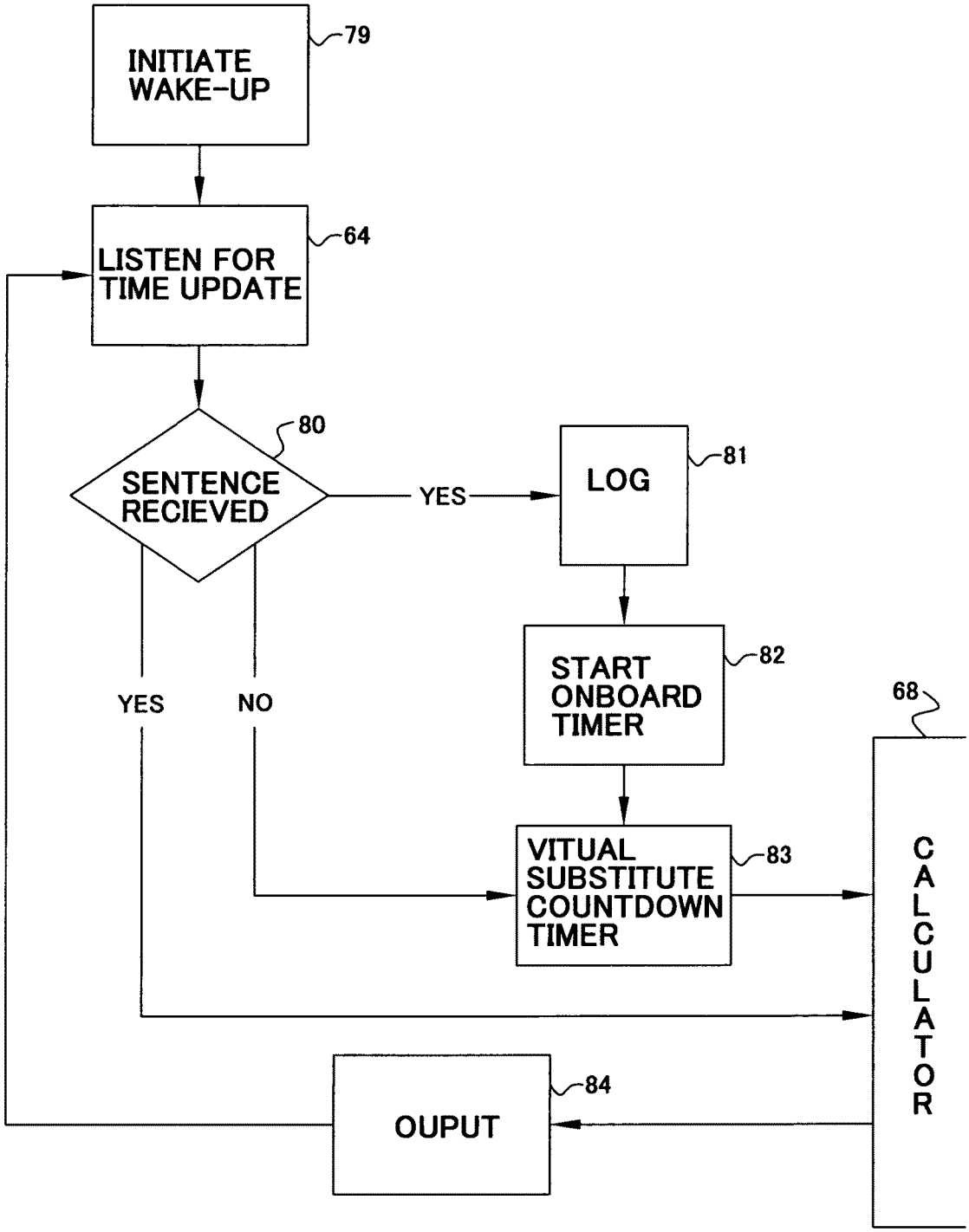
FIG. 14 shows details for the instance of a corrupted status input.

For these blackout events, the case of the status input 14 in [FIG. 2] would include initiation of status inputs 79 in [FIG. 14], and starting of the listener 64 for a sentence 7 in ([FIG. 9]). If the sentence was received 80, (in [FIG. 14]) a log 81 is started for onboard timer 82 and a virtual substitute countdown time 83 is began. Meanwhile, the update 64 that is passed through the receiver 80 is sent to the calculator 68 for a scan by the calculator 68. An output 84 is posted and a new scan is started. If the sentence 7 is not received 80, the virtual substitute countdown time 83 is deferred to for the next scan, a calculation is made by calculator 68, an output 84 is posted and the scan process is started again.

Figure 15:
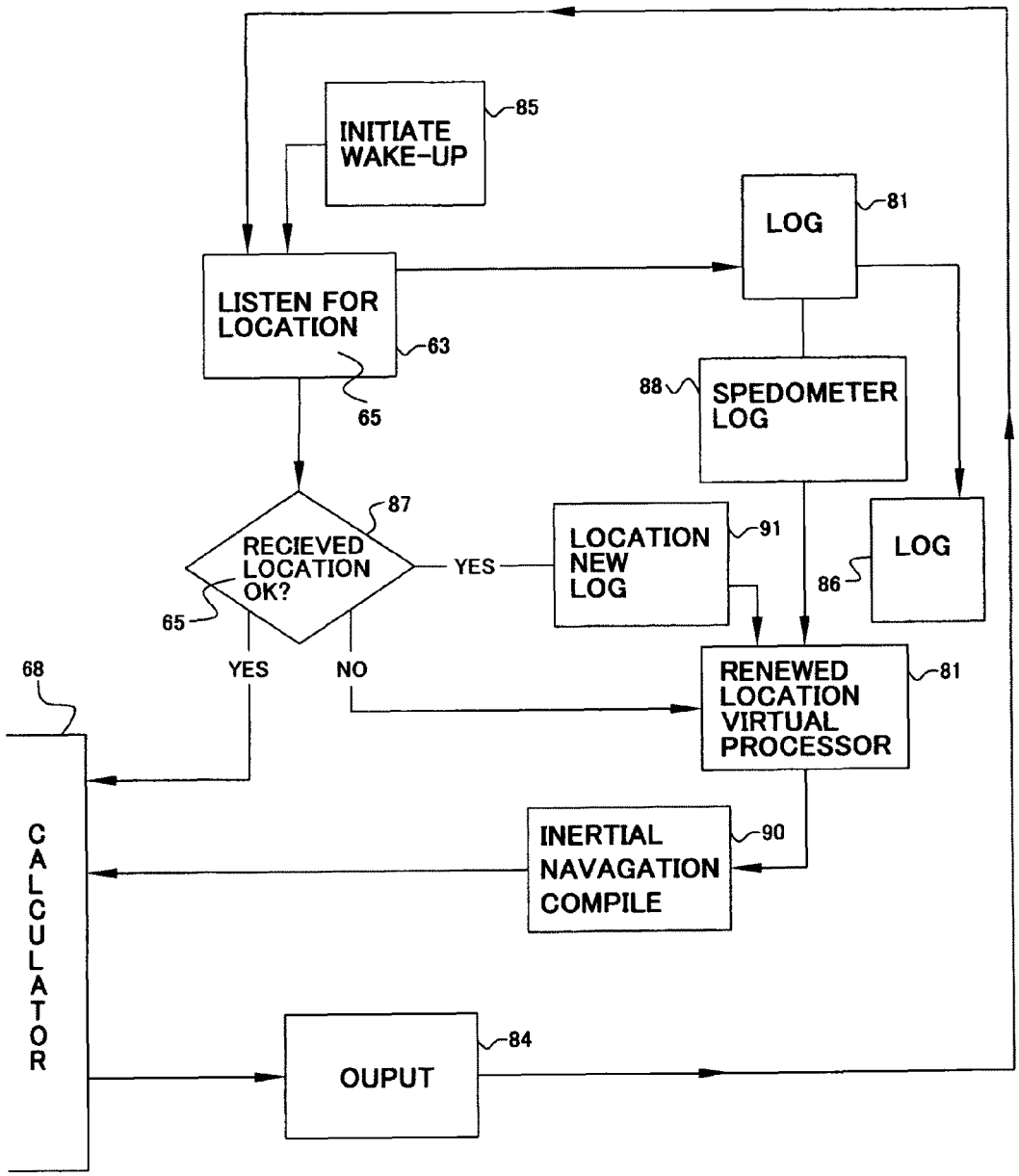
FIG. 15 shows details for the instance of a corrupted location input.

For a location input blackout substitution system in [FIG. 15], there would be an initiation 85, and the location listener 63 would start receiving inputs. If the location input 65 were OK 87, it would be passed through to the calculator 68 for a scan and an output 84 and a restart of the process.

Meanwhile back on the rest of the initial scan, as the location package 65 was passed, it would also be logged in both timer log 81, and location log 86 (for location and timing purposes) and continuous logging with onboard speedometer 88 would begin. Note that onboard speedometer 88 could be in the vehicle speedometer or come in as GPS speed inputs. Each of these logged inputs would serve the renewed virtual location processor 89. Throughout the next series of scans, if there were an event of the location sentence 65 not coming through 87, the scan would defer to the renewed location virtual processor 89, which would compile a substitute inertial navigation update 90, or "virtual location" and send it to the calculator 68 for a scan and an output and a restart of the scan process. To prevent "drift" between real and virtual inputs, new location log 91 would be able to update, correct and calibrate renewed location virtual processor 89 as often as each scan if need be.

Figure 16:
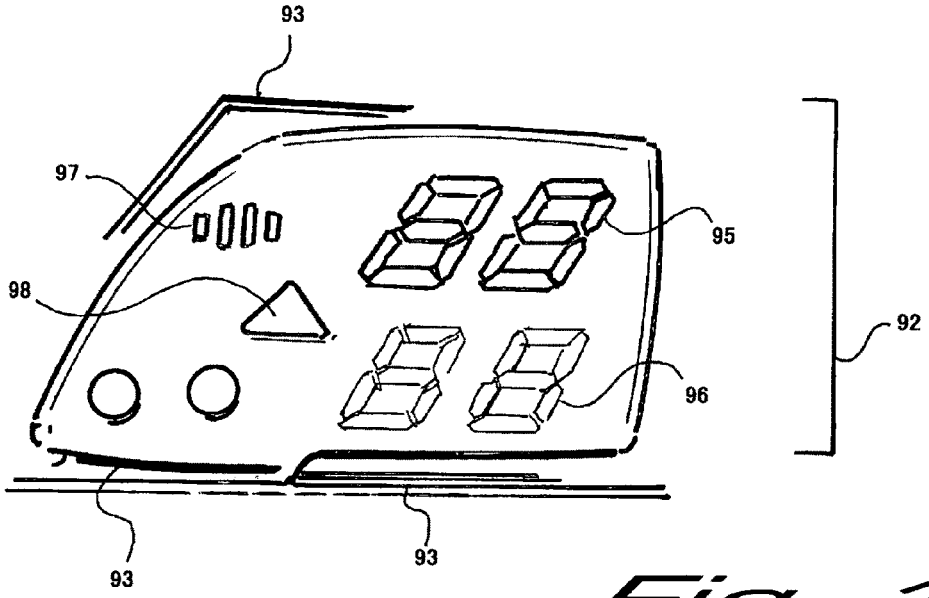
FIG. 16 shows an add-on receiver.

Actual readout could come as an add-in module 92 in [FIG. 16] that adheres, suctions, bolt-on-base-mounts or the like 93 to windshield, dashboard 94 or the like. Alphanumeric speed readout 95 could tell the speed that needs to be attained and maintained in order to get through to the green. Interactive comparison of actual speed that motorist is going 96 could be easily understood and might be driven by GPS speed or even by change in position calculations of local RF location means. Readout of "actual" 96 might not be as prominent (i.e. color and brightness) as "assignment" readout 95. Speaker 97 would allow for audio (beeps voice, whistle and the like) outputs. Other graphics 98 can be integrated with alphanumeric outputs 95, 96.

Figure 17:
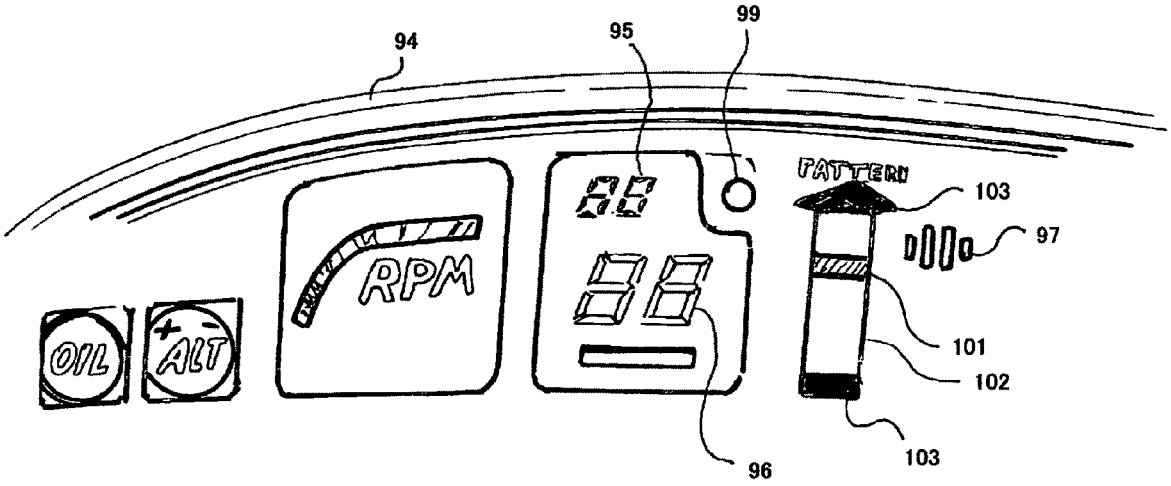
FIG. 17 shows a built in receiver.
Figure 18:
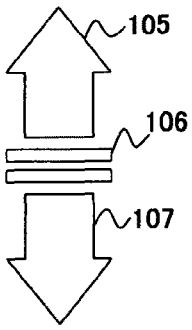
FIG. 18 shows graphics with up and down arrow, as well as equal sign.
Figure 19:
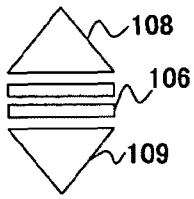
FIG. 19 shows simpler up, down triangle with equal sign
Figure 20:
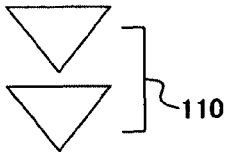
FIG. 20 shows double downward facing triangular arrows that emphasize slowing down.
Figure 21:
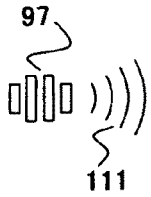
FIG. 21 shows sonic/audible readout
Figure 22:
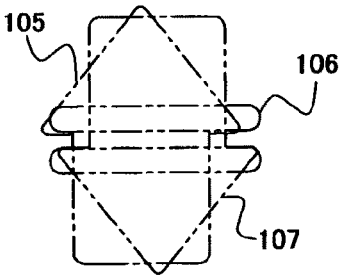
FIG. 22 shows layout/relative location possibilities for arrows graphics.
Figure 23:
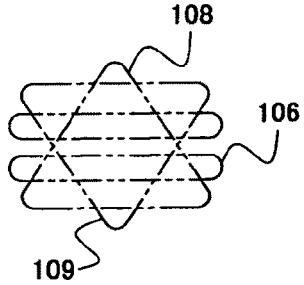
FIG. 23 shows layout/relative location possibilities for triangle arrows graphics.

An OEM installation in dashboard 94 in [FIG. 17] might include alphanumeric readout 95 in a small but prominent output with brilliant power/brightness or colors mounted near vehicle speedometer readout 96 for an interactive comparison. Features might include on off switch 99, graphical indicator 100 of where vehicle is in the pattern/hierarchy which might include a green band 101 in a green graphical frame or outline 102 with red at either end of the column 103 indicating voids or empty spaces 35 in [FIGS. 4 and 6]. Also a speaker 97 in [FIG. 17] could be mounted in the dash, but just as easily, the sound could come through the existing sound system of the vehicle (not shown).

Graphics outputs could include the likes of incandescent, LED (light emitting diode), sprites, art files, or the like, in a color LCD screen; 105, 106, 107, 108, 109, 110 in [FIGS. 18 through 23]. Symbols, graphics and progression can include green upward arrow 105/white equal sign 106/red downward arrow 107 combination (in [FIG. 18]); upward and downward triangle 108, 109, with equal sign106 in [FIG. 19]. Double red downward triangles 110 in [FIG. 20] (or arrows or the like) could indicate too fast, as well as a beep or whistle 111 from speaker 97 (in [FIG. 21]). Symbols could take up the same space in a sprite, or LED driven indicator or the like as they take turns flashing including arrows 105, 107, equal sign 106, in [FIG. 22] as well as triangles 108, 109 with equal sign 106 [FIG. 23].

Alternative Embodiment

Figure 24:
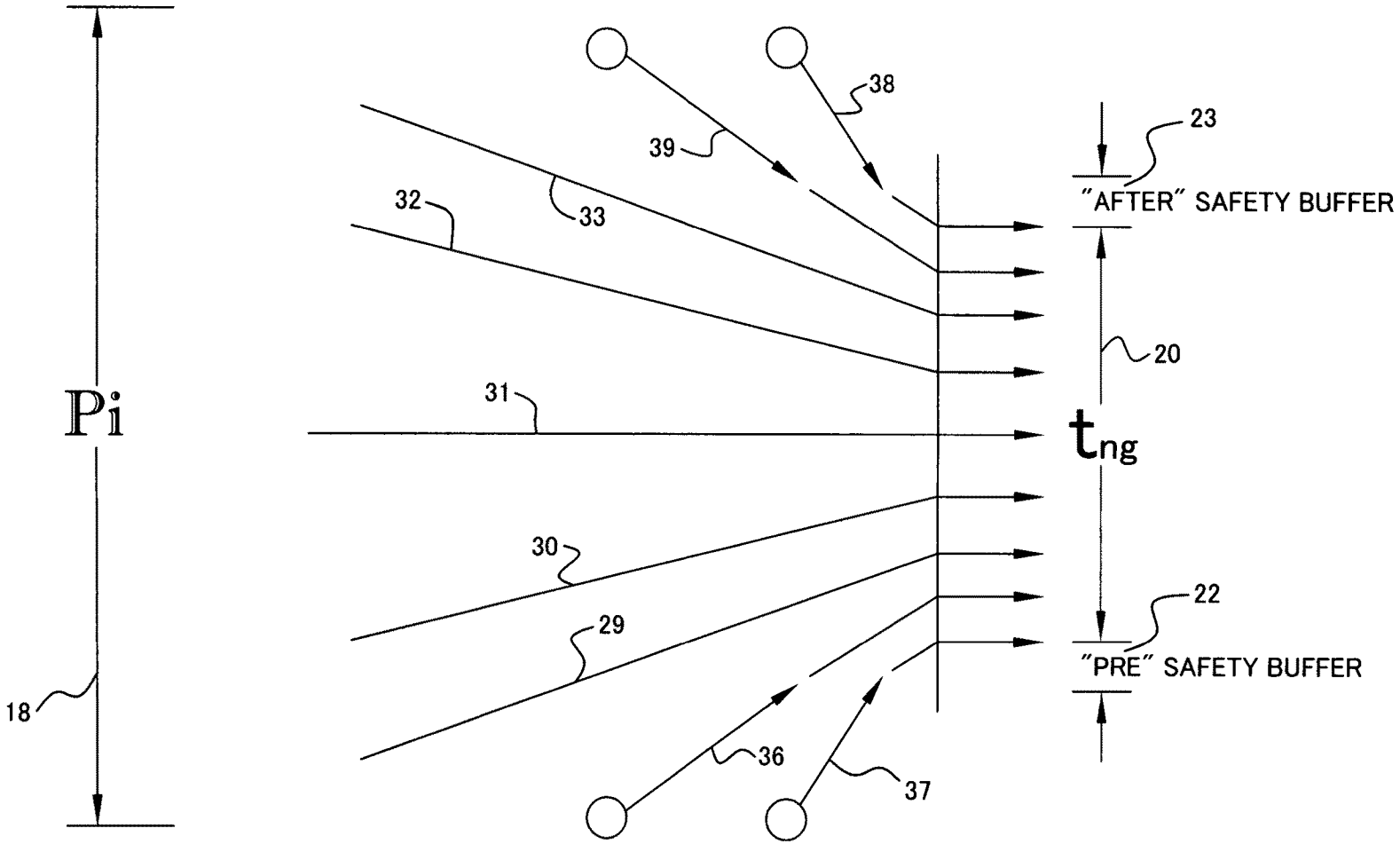
FIG. 24 shows alternate embodiment including looser interpretation of node with even distribution throughout net green and even distribution of converging standard and wayward speed assignments.

An alternative embodiment is included where there is a looser interpretation of a node 28 (in [FIG. 7]). Instead of the node being a point or threshold 28, it is more like a range 48 and could even range for a substantial part of the trap between the time of beginning of compression to the intersection 4 in [FIG. 7]. In [FIG. 24], instead of having wayward traffic 36, 37, 38, 39 arrive and be directed to localities of safety time (distance) buffers 22 and 23 in [FIG. 6], it is evaluated as if there were a moving threshold with the offset between Pi at random pattern 18 and Pi at signal 26 (in [FIG. 4]), being evaluated for each scan of position X (in [FIG. 4]). With looser interpretation of node, traffic paths 29, 30, 31, 32, 33 in [FIG. 24], and including wayward traffic from voids 36, 37, 38, 39 in [FIG. 24] is all more evenly dispersed throughout Tng 20, where paths are equally convergent, and there is less likelihood of overstuffing of wayward traffic into safety buffers 22, 23.

Alternate Embodiment #2

Figure 25:
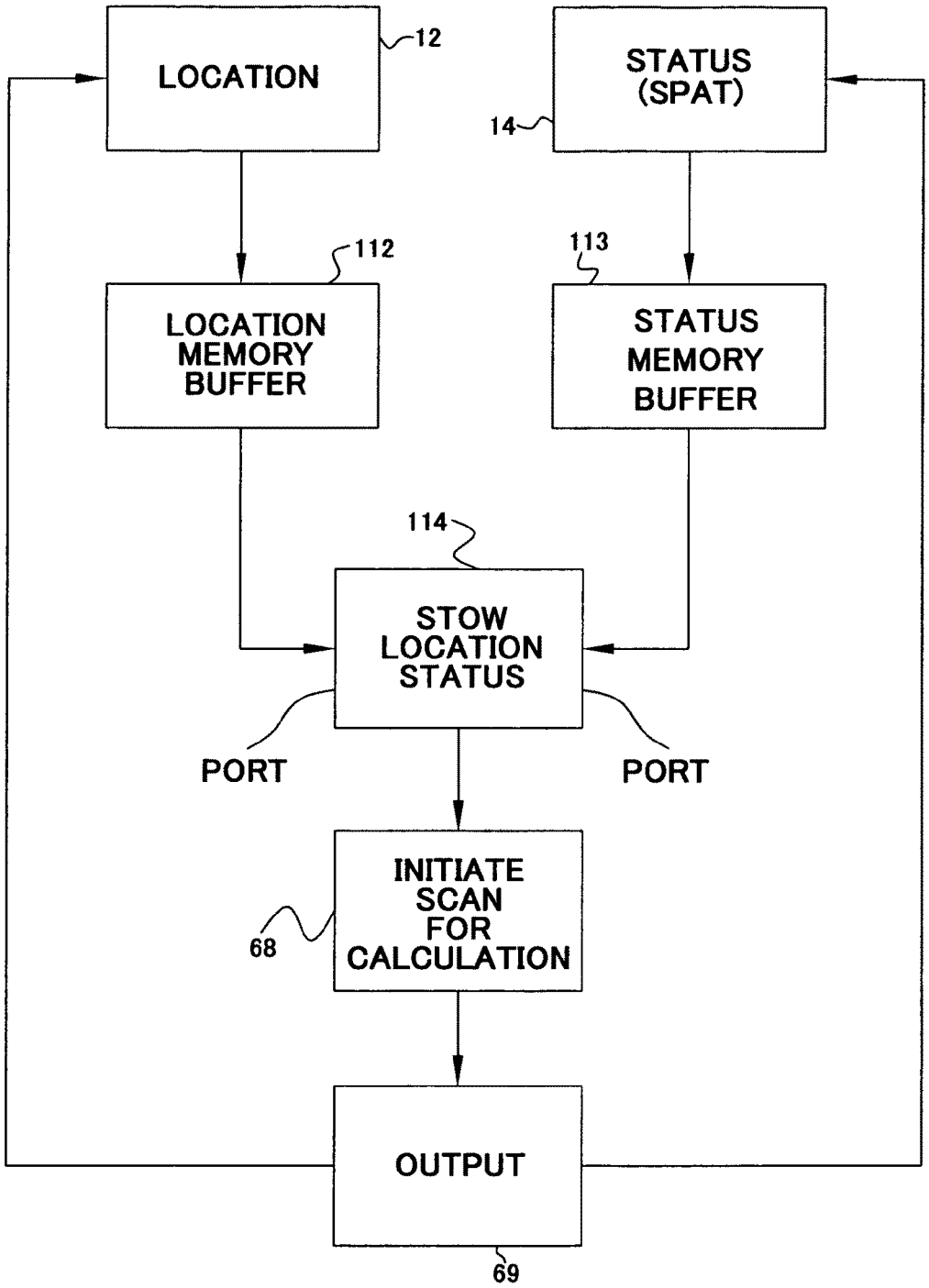
FIG. 25 shows alternate embodiment with streaming as opposed to event based inputs, and including memory buffers.

Location 12 and status 14 (in [FIG. 25]) can be entered in streaming form (as opposed to events) into location memory buffer 112, and status memory Buffer 113 respectively. The buffers are funneled into stow of location and status 114 through location port 13 and status port 15 respectively, and a scan is initiated 68, and an output 69 is posted and the process is started over again.

Alternate Embodiment #3

Figure 26:
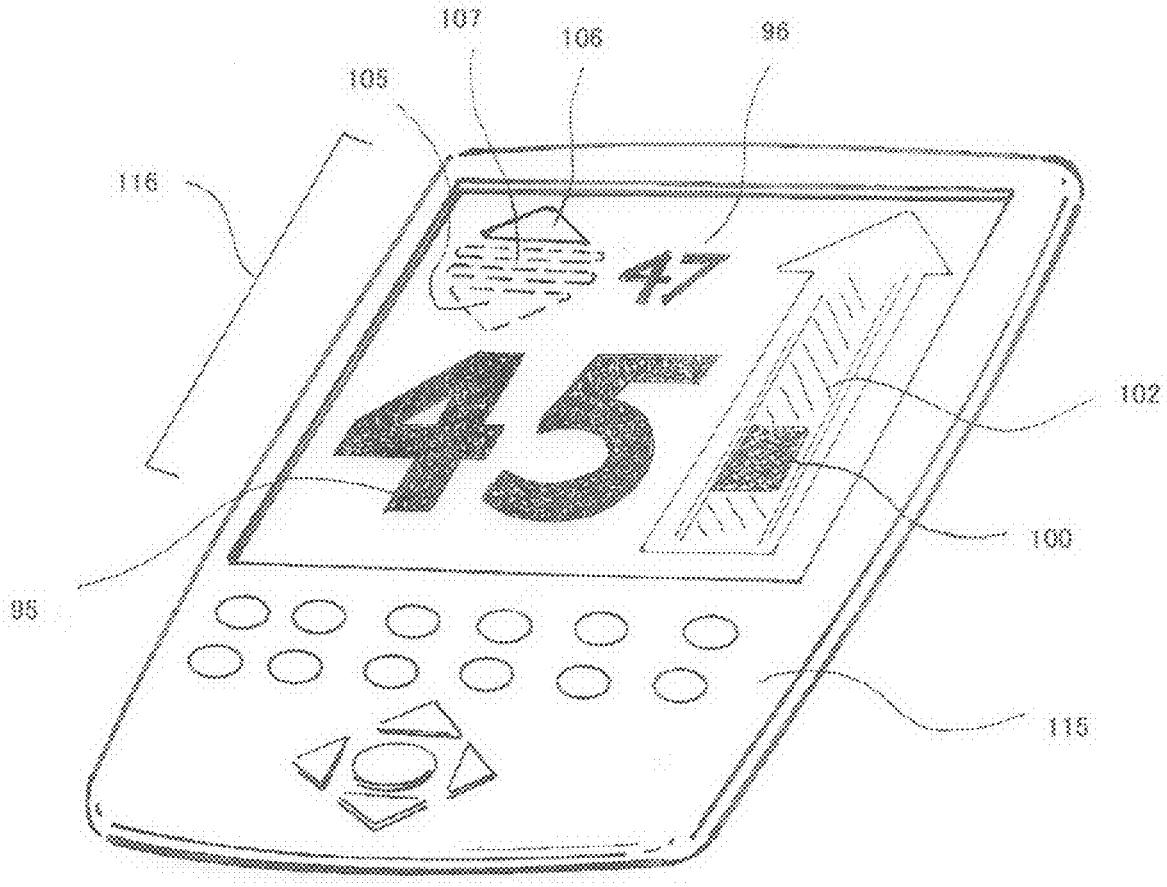
FIG. 26 shows an alternate embodiment of the receiver/calculator/readout being part of a bigger device.

Receiver/Calculator/Readout RCR unit can be part of a larger device in [FIG. 26] such as a small computer, map readout or the like 115. Screen 116 (LCD, CRT or the like) caries sprites, art files, fields, animation cells, or the like which include graphical position indicator 101 within FLOW pattern graphic 100, upward, downward arrows 108, 109 respectively, equal sign 106, speed assignment 95, actual speed (for interactive readout) 96. Processes such as location sentences 65 (in [FIG. 10]), status time data packet 7 (in [FIGS. 1 and 9]), inertial renewed location virtual processor 89 (in [FIG. 15]) are processed along with functionality of the device 115.

What is claimed is:

1. A traffic managing system comprising of:

a traffic signal governing an intersection, a signal sequencer that controls said traffic signal at said intersection, wherein control includes at least the phases of Red, Green, Yellow, or "RGY", and wherein service cycle period of phases of said signal is Pi, or "Period of the Intersection", a further sequencer means that is operatively connected to said signal sequencer that operates under the paradigm of FLOW or "Fast Lane On Warning" wherein the objective of said further sequencer means is telling approaching vehicles what speed to go in order that said vehicles travel through said intersection while signal is in green phase, a transmitter means that sends out appropriate messages to incoming vehicles of the "status" of the signal, or where said signal is in the phases of said signal, or data including "SPAT": "Signal Phases And Timing", a system of vehicle onboard processor means that are receiver and/or calculator and/or readouts: "RCR", a system of location seeking means whereby said vehicle-onboard units are able to procure or ascertain location of their associated vehicle with respect to said traffic signal and intersection, whereby distance from intersection to actual vehicle is attained or solved for, wherein said "status" or "SPAT" data is sent and received through wireless means, and intended for one or more lanes of road in one or more directions, wherein sequences generated from said "fast lane on warning" sequencer through said transmitter means includes the intention for traffic patterns to be compressed or consolidated beginning at a place up the road where said traffic patterns substantially start out as end to end touching pattern lengths of Pi in time as well as distance, and wherein said end to end touching patterns represent random pre compressed, pre consolidated incoming traffic, and wherein said patterns continue from a point of the passing of said patterns through said beginning place to be consolidated and/or compressed until said traffic patterns substantially reach the region of said intersection, and wherein said pre-traffic-managed full patterns of Pi get compressed or consolidated substantially into a "net" green pattern "Tng" substantially by the time the pattern reaches said intersection, wherein said end to end touching time periods of Pi represent a pre compressed, pre consolidated, pre traffic-managed infeed of traffic, and correspond to end to end touching Pi time periods of repeating cycles of RGY, regardless of the amount of time of offset from the start times of the Pi of said signal and start times of Pi of said random incoming traffic, wherein receiver/calculator/readout, "RCR" means calculates using the two types of data: "distance to intersection" and "time left in SPAT", and wherein said "RCR" outputs a readout, and wherein said outputted readout is perceived by motorist/vehicle, wherein because of perception by motorist/vehicle, said motorist/vehicle knows what speed to go in order to pass through the green phase, wherein collective vehicles having come in a previously random string of traffic before receiving any consolidating and/or compressing traffic managed "fast lane on warning" outputs/readouts are given converging speed assignments or readouts, wherein said readouts are compressed or consolidated per unit length and time ("space time") in a net green length and time that is full of traffic, wherein said pattern becomes a consolidating and/or compressing traffic managed "fast lane on warning" pattern that is substantially the length and time period of Tng, that goes through said signal during green phase; wherein said readouts optimize functions of safety and mobility:

A. wherein no assigning causes motorist to exceed the safe speed limit,

B. wherein cross assigning of speed assignments is discouraged to the highest possible extent (i.e. within the limitations of resolution) during compression, consolidation, i.e. wherein said speed assignments do not cause other assigned vehicles to cross-converge or over-converge, overtake or pass one another based on assignments, C. wherein a hierarchical position of a vehicle in the hierarchical order and therefore substantially percentage based position of vehicles within said consolidating and/or compressing traffic managed "fast lane on warning" pattern at arrival to intersection of said consolidating and/or compressing traffic managed "fast lane on warning" pattern is substantially proportional to where said vehicles were in the hierarchy of a previously Pi-proportioned-fragment or segment of random traffic string before said vehicles started receiving readouts/speed assignments and therefore before compression, wherein receiver/calculator/readout means receives data of status of consolidating and/or compressing traffic managed "fast lane on warning" sequencer of "Signal Phase And Timing"; "SPAT", and including the option of said data leading to a time-remaining-consideration, wherein said readouts include the option of leading to a time-remaining-consideration to a particular slot or place or position in the consolidating and/or compressing traffic managed "fast lane on warning" pattern hierarchy for said vehicle(s).

2. The traffic management system of claim 1 wherein a portion of said random string whose length starts as essentially a length of the product of Pi*(safe speed limit)

is substantially reduced to a length of Tng whose length (as well as time period of passing a relative static reference point) is substantially less as it moves through the traffic signal while in net green while full of the traffic, wherein that said traffic was previously the said random Pi proportioned fragment or segment of the incoming feeding stream of a random string of traffic, wherein said shorter net green lengths as compared to service cycles Pi associate multiple consolidating and/or compressing traffic managed "fast lane on warning" lanes that can include possibility of traffic running in the opposing (perpendicular) direction such as North-South versus East-West, wherein if there is in the event of Fast Lane On Warning activity governing said opposing directions, said opposing directional traffic consolidating and/or compressing traffic managed "fast lane on warning" patterns can take turns going through same intersection at reasonably high velocities without having to come to a stop.

3. The traffic management system of claim 1 which includes a start or an arrival function, Pa, wherein said start or arrival function is between zero and said service cycle Pi of traffic signal, wherein said arrival function counts down from the service cycle period Pi to zero, than starts at the service cycle again, wherein said arrival function repeats through a cycle just like RGY and with the same period Pi, wherein there is enough offset from the start of said arrival function to account for appropriate functions including distances, speeds, and time periods to particularly serve the intersection that said system is installed at.

4. The traffic management system of claim 3 wherein there is a less clearly defined threshold or node wherein a general application of enhancements or a more independent set of speed assignments bring traffic through during the green phase, wherein distance form intersection X is taken each time a scan of the calculation is done by the receiver calculator wherein there is a possibility for said offset of Pi for traffic signal and Pi for consolidating and/or compressing traffic managed "fast lane on warning" mobile readouts to be reevaluated each time a new X is scanned as if there were a "moving" threshold of where compression begins, wherein there is not necessarily a node, or wherein there is a looser interpretation of a node wherein instead of a substantially distinct set distance from the intersection where a first distance X is taken, that there is a set distance X that is taken anywhere within reasonable trap range wherein:

the speed limit is not exceeded, there is maximum possible discouragement of cross assigning of speed assignments in outputs (i.e. to within the limitations of resolution), wherein there is a general proportional resemblance of the preexisting hierarchy, wherein said preexisting substantially represents pattern before compression and speed assignments, wherein said resemblance substantially happens as the consolidating and/or compressing traffic managed "fast lane on warning" pattern nears the intersection, and where there is a generally emerging proportion of arrivals at the end of the consolidating and/or compressing traffic managed "fast lane on warning" compression as there was when the traffic was first encountered as a random traffic string before compression occurred, wherein there is a following, and especially forward (said forward including possibility of receiving stray traffic from preceding consolidating and/or compressing traffic managed "fast lane on warning" pattern) safety buffer time periods, wherein said safety buffer time periods can absorb any anomalous activity not relating to that activity of a consolidating and/or compressing traffic managed "fast lane on warning" pattern as reinterpreted by each new location of X, wherein there is a possibility for looser interpretation of safety buffers that collect vehicles from voids and empty spaces as interpreted by more distinct boundaries and more distinct nodes (as mentioned in claim 9 but still with concept of "range" instead of "point"), and while retaining possibility for safety buffers surrounding Tng and being the difference between Tng and total green phase G, and wherein there is a possibility for more evenly distributed traffic in the event of much wayward traffic joining in consolidating and/or compressing traffic managed "fast lane on warning" pattern and wherein there is less likelihood of overloading overstuffing buffers with oversize numbers of mathematically enhanced traffic from voids.

5. The traffic management system of claim 1 wherein any of safety buffer time periods or zones can either precede, follow, or do both around a "net" green fragment, Tng, of green phase (part of RGY), said net green fragment being the part of green which is intended for consolidating and/or compressing traffic managed "fast lane on warning" pattern traffic to go through on, which would be a fragment of the whole green phase, wherein said net greens and before and after buffers can apply to other appropriate sub phases including left turn, green arrow, four-way-plus systems, wherein there is a possibility for a buffer time period ahead of consolidating and/or compressing traffic managed "fast lane on warning" pattern that accounts for conditions, instances and events causing wayward traffic that may precede said consolidating and/or compressing traffic managed "fast lane on warning" pattern including early arrivals, especially vehicles that came from the preceding Pi, and the clearing out of static standing traffic at the intersection, wherein there is possibility for a time buffer after consolidating and/or compressing traffic managed "fast lane on warning" pattern that accounts for conditions, instances, and events after consolidating and/or compressing traffic managed "fast lane on warning" pattern including stragglers, traffic that turns onto the consolidating and/or compressing traffic managed "fast lane on warning" trap while the pattern is going through, and other wayward types of traffic that happens after consolidating and/or compressing traffic managed "fast lane on warning" pattern goes by, wherein the size of said buffer time periods can range between zero and whatever reasonable time that is needed to effectively allow for said types of wayward traffic.

6. The traffic management system of claim 5, wherein the following relationship of:

$$Vsa = \frac{X}{(Pi - Pa) + Pi + pgS - \left[1 - \frac{(Pi - Pa)}{Pi}\right]Tng}$$

where

Where Vsa=speed assignment

X=distance to intersection

Pa=arrival point in time that vehicle enters trap (i.e. crosses the node)

Pi=service cycle period of intersection pgS=pre green safety time buffer period

Tng=net green period where traffic goes through, wherein there can be said safety buffer time period after said Tng, Tsf wherein said Tsf is created by shortening the duration of Tng wherein Psf=G−pgS−Tng.

wherein also, there is the possibility for multiple nodes wherein said relation includes:

$$Vsa = \frac{(n)X}{(Pi - Pa) + (n)Pi + pgS - \left[1 - \frac{(Pi - Pa)}{Pi}\right]Tng}$$

wherein said multiple nodes can be further up said roadway, wherein there can be a possibility that said multiple nodes are multiple numbers of the first node where "n"=1, and can be expressed as (1)X, then as (2)X, (3)X, (4)X, (5)X and so on.

7. The traffic management system if claim 6 wherein said Tng can be made smaller and smaller until it is very small, or until Tng turns to zero, then the wherein the term $$''-\left[1 - \frac{(Pi - Pa)}{Pi}\right]Tng''$$

drops out and the zone space-time of Tng becomes a point, wherein there is a substantially a single target somewhere within the Green phase, wherein placement of said target can be determined within Green Phase how big pgS is, wherein said target point, as well as small Tng space time can serve to clarify readouts to gain resolution and discourage low resolution assignments causing vehicles to miss said green phase.

8. The traffic management system of claim 1 wherein there is essentially a node, or threshold starting substantially where compression begins, A. which could be like a reference point given by where speed limit and substantially half speed limit (although allowing for variation of yellow, pedestrian, green arrow, left turn or the like thus making said "substantial half speed" not exactly half) would coincide, B. or given by a place, distance where Pi and (2*Pi)/2 coincide (where Pi is service cycle of intersection, C. or X=(Pi/(1/slow speed−1/fast speed))

D. or X=Pi*speed limit (where X is distance of the node to the intersection)

E. or any combinations of A through D or any of their like.

9. The traffic management system, node, and threshold of claim 8 wherein countdown function Pa is to be taken, wherein as vehicle(s) progress towards, intersection, said threshold is the last place where a complete set of readouts or speed assignments can be given with the tail end of one Pi linking up with the beginning end of the next Pi without any blind spots or voids, and including the possibility for multiple nodes further up at substantial locations of multiples of Pi*Speed Limit, wherein those multiple nodes also are points where a complete set of speed readouts can be taken for any time, and where there would be no blind spots or voids, wherein at said node, the usual parameters for consolidating and/or compressing traffic managed "fast lane on warning" converging readouts and getting through during net green phase are essentially set, wherein after vehicles cross said node, there can be instances where traffic can miss a consolidating and/or compressing traffic managed "fast lane on warning" pattern and be in a void, blind spot or empty spaces, "vacated area", with regards to speed assignments given at a node wherein vehicles would be outside the realm of typical compression and converging speed assignments, that properly-compression-informed vehicles would not be in, however that may be filled with improperly informed vehicles moving ahead or falling behind said consolidating and/or compressing traffic managed "fast lane on warning" pattern, wherein if a vehicle were in a place or time where there would be an absence of typical readouts or speed assignments, that said vehicle would still be able to receive some kind of outputs throughout the repeating Pi and therefore still make it into a consolidating and/or compressing traffic managed "fast lane on warning" pattern and still go through said traffic signal during the green phase, wherein examples of why vehicles would be in a blind spot or empty space could include:

A. Vehicles that turn onto said consolidating and/or compressing traffic managed "fast lane on warning" lanes before or after consolidating and/or compressing traffic managed "fast lane on warning" pattern passes by, B. Vehicles that turn onto the trap area during a consolidating and/or compressing traffic managed "fast lane on warning" compression but have to wait till the pattern passes, C. Improperly functioning vehicles such as those whose speedometer may be off, wherein said improperly functioning vehicles that will be informed or compressed by mathematical enhancements, manually programmed enhancements or the like to safely and effectively bring them into a consolidating and/or compressing traffic managed "fast lane on warning" zone, and in those instances, wherein mathematical enhancements, manually programmed input, or the like especially reassigns said extra traffic into pre-consolidating and/or compressing traffic managed "fast lane on warning" pattern, and following consolidating and/or compressing traffic managed "fast lane on warning" pattern buffers or like places wherein said enhancements would not cause speed assignments to exceed the speed limit, and wherein said enhancements would discourage to the highest possible degree (as restricted by limitations of resolution) any cross-assigning, and wherein said enhancements would continue the same proportions as much as possible the positions relative to whole of said consolidating and/or compressing traffic managed "fast lane on warning" pattern similar in Tng transit as said pattern was when first encountered, wherein said pre and following consolidating and/or compressing traffic managed "fast lane on warning" pattern buffers can include possibility for secondary buffers specifically intended for and set aside for vehicles receiving mathematical enhancements and while also leaving possibility open for standard safety buffers (as mentioned in claim 3) before and after Tng and consolidating and/or compressing traffic managed "fast lane on warning" pattern, wherein said mathematical enhancements manual programming or the like sends turn-ons, stragglers, latecomers form the previous consolidating and/or compressing traffic managed "fast lane on warning" pattern into some space allotted in said pre green safety buffer time period, wherein said traffic that might have been arriving in a void can still make the nearest or following, or otherwise appropriate consolidating and/or compressing traffic managed "fast lane on warning" pattern.

10. The traffic management system of claim 1 including wireless transmission of the necessary methodology represented by the group that includes packet sentence, string, code, frequency, wherein transmission of status information includes A. type of cycles and phases involved in the traffic signal, B. where the signal presently is in the phases of said signal in real time, Pa, C. how long the net green Tng is, D. how long the cycle Pi is, and including other information either which comes as wireless data or wherein said information be solved for onboard given wireless data including E. time left to the beginning of net green Tng, F. Time left till specific vehicle's particular slot or place in the hierarchy in the consolidating and/or compressing traffic managed "fast lane on warning" pattern when said pattern actually substantially reaches the intersection.

11. The traffic management system of claim 10 wherein said data comes in the form of a more non traditional packet including possibilities of a single or multiple frequency, said single or multiple frequency that is encoded, non traditional analog or digital code or message, repeating frequency pattern, repeating digital code or message, wherein said non traditional packet might govern different characteristics (location and status for example) that could serve as incoming signals that determine data that is translatable for outputs that can be used as consolidating and/or compressing traffic managed "fast lane on warning" readouts wherein changes in non traditional packet could be translated into condition that could represent location or status and could net into distance X and time to net green or time to slot or hierarchical position in consolidating and/or compressing traffic managed "fast lane on warning" pattern going through net green, wherein said repeating pattern could repeat through the time period of Service cycle Pi.

12. The traffic management system of claim 10 wherein sentences come into said receiver in streaming fashion, coming in from sources of vehicle position (leading to result of distance to intersection X), and traffic light status, leading to result of arrival time Pa, and time left till position, "slot" in consolidating and/or compressing traffic managed "fast lane on warning" pattern as it goes through green, ultimately leading to result of Vsa, wherein said receiver includes the possibility to take in both data from location, and data from status at same time by using multiple simultaneous streaming input means including funneling data, switches, sentence gatherers, multiple and single memory buffers, for multiple input at the same time.

13. The traffic management system of claim 1 wherein said receiver functions as an event driven, and includes possibility of being an action specific Integrated Circuit; "ASIC", wherein said event includes possibility of being the reception of input into said receiver RCR, wherein there is a possibility for said driving of scan event to be reception of data packet, wherein said scan is generated triggered or set off by either of said "location" data incoming packet or frequency or said "status" data packet or frequency from consolidating and/or compressing traffic managed "fast lane on warning" sequencer, wherein said event can happen as often as a few times per second, and just as easily, many hundreds of times per second, or thousands of times per second, and wherein the data that does not function as the trigger of the scan, i.e. the "background", can be played until an event occurs, wherein said event could include possibility of incoming triggering data, interrupt into background, time out, time delay, timer accumulated, timer device switching listener from one port to another wherein minimal memory needs to be aboard said RCR, wherein said ASIC ("action-specific integrated circuit") can be simple, durable and inexpensive wherein simplicity may contribute to durability and reliability.

14. The traffic management system and receiver of claim 13 including adaptation possibilities for event driven or streaming inputs, wherein instead of a simple basic ASIC, there can possibility of a more sophisticated processor, wherein said processor includes a range of some to a large amount of onboard memory, wherein said processor can include possibilities of timers, counters, countdowns, timer delays, time accumulators, wherein said receiver RCR can include stowable memory, wherein the RCR processor possesses necessary on board ability such that readouts, human machine interface, HMI, remains continuous in spite of blacked out, corrupted or lost data wherein said ASIC with stowable memory lends to the possibility of said ASIC with stawable memory performing memory based computing, wherein with said advanced components including timers and stowable onboard memory, there is also the possibility for simpler and more straightforward programming, wherein time stamp programming and processing can be taken advantage of, including possibility for realtime Clock "RTC" usage, wherein said memory can be utilized for a multitude of failsafe characteristics for the receiver RCR including possibilities for correctable sentence, prepared predownloading, make-up ability, time tolerance correctability, backup output (including inertial navigation) methodologies, wherein reliability in data packet reception both as real and as virtual data packets is improved, wherein latencies can be made up for or otherwise absorbed, wherein readout and human machine interface, HMI, is more continuous, wherein due to said improved data packet reception and continuity, resulting speed readouts Vsa are more reliable and more perceivable.

15. The traffic management system of claim 14 wherein wireless data including sentences, packets, digital, analog frequencies can be made up with divisions in the packet such that if parts of data packets are readable while fragments of them may be corrupted, that reliable substitute data can be extracted from following or preceding data packets' fragments thus reestablishing a fully functioning condition.

16. The traffic management system of claim 14 involving prepare-in-advance characteristics including pre-sensing, pre-downloading, wherein there is a possibility for pre loading data in anticipating fashion before the necessity for outputs wherein the data for output would be prepared for, wherein corrupted data can be dealt with including possibilities of absorbed bad sentences or skipped bad sentences, wherein latencies can be absorbed, or countered, or accounted for, wherein there is possibility for a delay in readout in concert with a data verification, data confirmation, data check for a full sentence, pre sense, pre download, download, while there can be ample and reliable data for output and backed up if necessary, wherein there can be possibility that outputs can be withheld until further confirmation, withheld within a triggered time out period, or within a scan-triggered allotted time period, wherein there can be the increased likelihood of a successful data transfer.

wherein there can be successful anticipation-based node crossing event log in spite of a data blackout, or a missed data time entry (especially in a case where there might be an input frequency slower than a few inputs per second), such time entry having taken place at the precise instant the node crossing took place, and wherein at that instant, the location data was not being downloaded, wherein there can be possibility that data can preload wherein output is in an anticipating condition wherein odds are greater for corrupted data to be skipped over, non counted resulting in increasing odds for non corrupted readouts, and wherein system is more reliable, wherein time tolerances of said receiver RCR can be included wherein if a sentence or data packet is corrupted, that there still can be a following one or ones read within enough time to still allow for an effective readout output, wherein there is still a chance that the system can adequately function in spite of more recently corrupted data packets as long as there is a calculator scan using older but adequately tolerant data within an adequately tolerant time period to complete a viable scan within a certain time limit, or time tolerance, wherein said RCR means allows for possibility of time-offset or latent data package fragments to still make a valid scan, wherein the system can still be reliable in case of partially or occasionally corrupted incoming data.

17. The traffic management system including onboard timer and memory of claim of 14 wherein once the RCR gets viable "location" and "status", data; once time and distance can be derived, there can be an internal process that uses that data to output consolidating and/or compressing traffic managed "fast lane on warning" readouts necessary to guide vehicle through said traffic light while it is green, in spite of data that might be missing, incoming data that might be blacked out, or otherwise be corrupted, wherein said onboard receiver/calculator/readout RCR can function as a one dimensional inertial navigation system, whereby where outputting can be backed up by onboard means once initial location and status has been established, in spite of continued missing incoming data, wherein said inertial navigation can be compatible with use of a substantially distinctly placed node or threshold, or just as easily be applicable to a looser interpretation of a node wherein said looser interpretation can include zones and tolerances instead of a distinct point or threshold, wherein said inertial navigation means can be driven by event based activity as well as streaming activity including importing of frequencies, digital, and analog as data, wherein there is a possibility for said inertial navigation serving as advanced anticipation backup, wherein events such as crossing said node or threshold can be anticipated and wherein if there is a data transfer blackout at the crossing of the node, processing and data (including real or virtual) can be adequate for entering the node crossing event for use in real or virtual speed readouts thereafter, wherein there can be successful anticipation-based node crossing event log in spite of a data blackout, or a missed data time entry (especially in a case where there might be an input frequency slower than a few inputs per second), such time entry having taken place at the precise instant the node crossing took place, and wherein at that instant, the location data was not being downloaded, wherein there is a possibility for said inertial navigation serving to switch to on-board processing using said timer and velocity data from on-board speedometer, including possibility of GPS as speedometer, to still know location, including derivation leading to distance to signal, in spite of location information blackout, wherein there is a possibility for said inertial navigation serving to switch to onboard processing to use timing means to continue to count down status, wherein said switched timing data could lead to or derive to time left to beginning net green, or time left to hierarchical position, slot; arrival at/through green, in event of a status input blackout, wherein there is a possibility for said inertial navigation serving to retain probability of speed assignment hierarchical placement slot continuity, wherein there is somewhat preservation of speed assignments from the crossing of the node event, threshold to finishing of assignments at or near crossing of intersection event, wherein there is a possibility for said inertial navigation serving to switch in and out as necessary to keep readouts/outputs, HMI continuous, perceivable, readable, wherein once the first data packet gets through, there is enough data so that said location and status data can be ascertained, there is enough data for said inertial navigation system to guide vehicle with appropriate consolidating and/or compressing traffic managed "fast lane on warning" speed assignments, wherein there is included the possibility for using velocity algorithms, wherein if speed is too high, back up system implies "go slower"; if speed is too low, back up system implies "go faster" than the "actual" or "interactive" readut, thus heading vehicle back to the originally assigned speed of said vehicle wherein the option is included that the relationship of:

$$V_{sa} = V_{actual} \pm \frac{dx}{dt}$$

can utilize velocity based inertial navigation where Vsa is speed assignment, and in the event of a blackout, with no true assignments coming in, Vsa becomes "virtual" speed assignment gained substantially near the node, V(actual) is the realtime speedometer based speed assignment being carried out, dX/dt is the change processed either in positive or negative direction by receiver calculator based on "go faster" or "go slower" variation of speed assignment, and wherein there is a possibility for nature of readouts also being based on "go faster" or "go slower", wherein there is the possibility for said processor to regard scans generated by events from said status and location packages (as well as streaming incoming data) as taking precedence over said backup one dimensional inertial guidance system for generating outputs, or wherein there is possibility for a master-slave priority relationship of real readouts having priority over virtual ones, wherein there is the possibility of a back up means in the event of data corruption, wherein there can still be continuity, wherein there can be the possibility for anticipating location to determine a "virtual"

node in the event of a blackout of data near the node so that the initial node set of assignments can be valid, wherein there is the possibility for real location and real time data to take higher precedence, i.e. supersede over onboard virtual data or data generated by inertial navigation, wherein when said higher precedence real location and/or real status/time data can be funneled into the processing as soon as it is determined to be viable, wherein backup readouts are deferred aside when real or true RCR inputs come in, wherein there can be a master slave relationship between true consolidating and/or compressing traffic managed "fast lane on warning" status and location inputs to RCR substitute processed inputs, wherein RCR substitute activity is corrected, updated, calibrated by true status and location inputs wherein such precedence insures maximum accuracy in consolidating and/or compressing traffic managed "fast lane on warning" status and location inputs, also wherein there can also be an alternate possibility for the virtual assignment, onboard generated inertial navigation to have a higher degree of precedence in the processing wherein there can be a range in number of real-data-corrections, frequency of real-data-corrections to virtual speed outputs, and wherein that range can go from many corrections by real data to only a couple of corrections, and wherein the virtual speed outputting assumes a higher priority, wherein said possibility of higher precedence of said onboard virtual resulting processing can provide for more clarity of status and location data due to longer available time periods for downloading.

18. The traffic management system of claim 1 that includes a range of degree of integration of said consolidating and/or compressing traffic managed "fast lane on warning" sequencer in with said RGY type sequencer, wherein one extreme of said range includes a substantially separate autonomous consolidating and/or compressing traffic managed "fast lane on warning" sequencer which might be connected to said traffic signal sequencer in a "piggyback or parasite" condition, and whereby said autonomous unit may merely take cues from said traffic sequencer in order to stay reasonably calibrated with said traffic sequencer whereby said consolidating and/or compressing traffic managed "fast lane on warning" sequences could stay coordinated with said RGY type sequences, and wherein other extreme of said range includes a substantially integrated consolidating and/or compressing traffic managed "fast lane on warning" sequencer that puts out status messages while being integrated with RGY traffic sequencer, whereby said integration allows for RGY type sequences and consolidating and/or compressing traffic managed "fast lane on warning" sequences to come from the same device, wherein there is a also a possibility for said consolidating and/or compressing traffic managed "fast lane on warning" sequencer to be a substantially autonomous unit, wherein there is a possibility for said autonomous unit to contain onboard and/or integrated timing means, wherein said autonomous extreme of consolidating and/or compressing traffic managed "fast lane on warning" sequencer can have a master slave relationship of RGY sequencer and consolidating and/or compressing traffic managed "fast lane on warning" sequencer respectively and wherein said consolidating and/or compressing traffic managed "fast lane on warning" sequencer takes updates, corrections calibrations from said RGY traffic sequencer ranging from occasional to often, depending on the frequency requirement for said updates, corrections, calibrations, wherein there is a possibility for said consolidating and/or compressing traffic managed "fast lane on warning" sequencer to be installed with an existing RGY traffic sequencer in a piggyback or parasite condition, wherein said parasite condition can provide for better integration with existing infrastructure, wherein there can be precedence, priority, master to slave relationships:

or wherein consolidating and/or compressing traffic managed "fast lane on warning" sequencer can be attached to a traffic sequencer in a master slave relationship wherein consolidating and/or compressing traffic managed "fast lane on warning" sequencer may have autonomous time outputs, but would still be corrected, updated, calibrated by the traffic signal, wherein said corrections, updates, calibrations discourage "drift" between said RGY and consolidating and/or compressing traffic managed "fast lane on warning" sequencers.

19. The traffic management system of claim 1 as it applies to allied mobility applications including vehicles on tracks, busses, trams, trolleys, trains, marine, bicycle, walking/pedestrian.

20. The traffic management system of claim 1 wherein there is the possibility of said mobile consolidating and/or compressing traffic managed "fast lane on warning" sequencer and receiver/calculator/readout RCR system or parts being integrated in with larger systems or devices, wherein there is the possibility of receiver being integrated in with instruments (i.e. instrument cluster, panel, console, in a vehicle), as "Original Equipment" (OEM), wherein there is a possibility of said receiver being added to vehicle interior as a separate mount, "Special Equipment", and wherein said special equipment could be externally mounted onto vehicle, wherein there is a possibility that said receiver is part of, or a function of, or a feature of a bigger hardware device, and wherein said bigger device includes possibility that it is part of a GPS, Map/directional locater, communication or directional device, hand held computer, wherein there is a possibility of said consolidating and/or compressing traffic managed "fast lane on warning" sequencer being part of a bigger system of traffic signal networks including block to block networks, coordinated networks, centrally controlled networks, green wave networks, wherein said consolidating and/or compressing traffic managed "fast lane on warning" sequencer integration serves to enhance said networks, and wherein traffic traveling through said networks can increase time that moving traffic travels through green phase due to consolidating and/or compressing traffic managed "fast lane on warning" systems.

21. The traffic management system of claim 1 wherein output includes the possibility of a double digit readout that includes the speed to go in order to get through to the green, wherein Vsa (of claim 6) is shown as a readout that is displayed in double digits wherein there is the possibility for comparison of what speed motorist/vehicle approaching signal/intersection should go, against what speed said motorist/vehicle approaching signal/intersection is actually going, and wherein there is opportunity of interactive display means, wherein there is a possibility for an analog readout as well as for an analog-like digital graphic output and including the possibilities for combinations of analog-analog; analog-digital; digital-analog, digital-digital, wherein said consolidating and/or compressing traffic managed "fast lane on warning" readout, speed assignment can be compared to actual speed vehicle is going, wherein there is possibility for output as graphics, wherein said graphics can include possibility for alphanumeric, light emitting diodes LED, art files in a color liquid crystal display LCD, sprites inside the art files, wherein said graphics include possibility for upward green arrow or triangle to indicate "faster", neutral equal sign for being in the proper tolerance of getting to green, downward red arrow or triangles to indicate "go slower", double downward arrows or triangles for "really go slower", wherein there is a chance for said graphics to be more easily understood, and wherein said graphics could be referenced faster, wherein said graphics include the possibility for position in hierarchy/consolidating and/or compressing traffic managed "fast lane on warning" pattern, wherein algorithm for said position could include ratio of Tng/slot.

22. The traffic management system of claim 1 wherein the receiver includes the option of the use of audio being involved in the output, wherein sounds could output yet allow for motorist to still keep eyes on road, better concentrate, and keep eyes on intersection when approaching same, thereby driving more safely, wherein audio could be easygoing as when for example motorist is near the proper speed output to go when approaching intersection, and wherein audio could more emphatic if speed were too fast or to erratic, wherein said double red facing down graphic that accompanies a "really go slower" output could be accompanied with sounds including beeps, buzzers, whistle.

23. The traffic management system of claim 1 including receiver type that "wakes up" and "shuts down", wherein there is possibility that wake-up is induced by said RCR being near enough in proximity to a consolidating and/or compressing traffic managed "fast lane on warning" transmitter that the power of the consolidating and/or compressing traffic managed "fast lane on warning" status transmission is strong enough to receive consolidating and/or compressing traffic managed "fast lane on warning" readouts and begin scanning and to receive wireless packages, wherein there is a possibility that wake-up is by means of Global Positioning System GPS that pinpoints "actual" location and compares it to known "virtual" location of a consolidating and/or compressing traffic managed "fast lane on warning" sequencer in an already-stored database, wherein there is a possibility for a shut-down means that includes progressive direction analysis along with location means that insures that vehicle is approaching intersection, and wherein at a moment that it is detected to not approach said intersection, as may be the case of direction/intent changes form consolidating and/or compressing traffic managed "fast lane on warning" lane including stopping, turning, U-turn (where said direction analysis would show said vehicle driving away from said intersection, i.e. "opposite" direction), and wherein after such changes, as well as approaching close enough to said intersection, said RCR shuts down, wherein along with said direction/intent changes shutting down consolidating and/or compressing traffic managed "fast lane on warning" readouts, there is possibility for intent changes including dangerous driving behavior, wherein for example after a double red downward arrow "go much slower" readout, and a double beep or buzzer, the system could shut down.

24. The traffic management system of claim 1 wherein the wireless means for status data coming from consolidating and/or compressing traffic managed "fast lane on warning" sequencer includes long range transmitters, wherein there is a possibility that beam can be particularly focused on consolidating and/or compressing traffic managed "fast lane on warning" lane, and wherein said focus can provide for more directional security, and wherein said focusing will require less power and reduce odds of consolidating and/or compressing traffic managed "fast lane on warning" system causing outside interference, wherein coded packet can provide for directional security and overall security, resistance to vandalism or "hacking", wherein said long range wireless transmitters combined with the optimum use of components including lower frequencies, effective antennas and lower baudrates can provide for lower numbers of transmitters in use, wherein wireless system is simpler more reliable, has minimal data loss and is less expensive, as well as possessing of long range signal clarity.

25. The traffic management system of claim 1 including the use of high frequency transmitters, wherein due to the shorter range of high frequency transmitters, the range of multiple transmitters can be concentrated on consolidating and/or compressing traffic managed "fast lane on warning" lanes, wherein if vehicles leave said consolidating and/or compressing traffic managed "fast lane on warning" lanes, there is possibility for vehicle to be out of range as soon as the consolidating and/or compressing traffic managed "fast lane on warning" lane is vacated thus allowing for easy shutdown in event of motorist turning out of consolidating and/or compressing traffic managed "fast lane on warning" lane, wherein said transmitters can be overlapped in each individual range, but closely associated with associated consolidating and/or compressing traffic managed "fast lane on warning" lane of said transmitters, and including condition wherein if the vehicle left the lane, the signal would disappear for lack of power due to RCR being "out of range", wherein said low range of said higher frequency had only the range to function substantially within each consolidating and/or compressing traffic managed "fast lane on warning" lane, and also wherein there can be better directional security due to locality of transmission to within confines of said consolidating and/or compressing traffic managed "fast lane on warning" lane, wherein higher bandwidth, baudrates of said higher frequency transmitters provides for better directional security, better overall security, resistance to vandalism or "hacking" and wherein higher bandwidth provides for capability of higher levels of encryption, wherein the directional security codes as well as vandalism security codes can be faster and more sophisticated with said higher frequency, wider bandwidth, faster baudrate, and wherein there can be better overall security by encrypting of packets with higher-bit security, wherein there is the possibility for fail safe transmitting due to many transmitters covering the same consolidating and/or compressing traffic managed "fast lane on warning" lane and many others still functioning in the event of a failed transmitter, wherein with the possibility for all transmitters of a consolidating and/or compressing traffic managed "fast lane on warning" lane to be networked into the same router simultaneously, there is the possibility that latency issues can be dealt with as a single offset, recalibration, wherein all said transmitters or modems being connected to said router provides for single latency and no individual latencies associated with multiple transmits which could adversely effect function including readouts, data, continuity.

* * * * *